US009645517B2

(12) United States Patent
Sato et al.

(10) Patent No.: US 9,645,517 B2
(45) Date of Patent: May 9, 2017

(54) CHARGING MEMBER, METHOD OF PRODUCING THE SAME, PROCESS CARTRIDGE, AND ELECTROPHOTOGRAPHIC APPARATUS

(71) Applicant: CANON KABUSHIKI KAISHA, Tokyo (JP)

(72) Inventors: Taichi Sato, Numazu (JP); Tomohito Taniguchi, Suntou-gun (JP); Takehiko Aoyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 80 days.

(21) Appl. No.: 14/338,107

(22) Filed: Jul. 22, 2014

(65) Prior Publication Data

US 2015/0087489 A1 Mar. 26, 2015

Related U.S. Application Data

(63) Continuation of application No. PCT/JP2013/005822, filed on Sep. 30, 2013.

(30) Foreign Application Priority Data

Sep. 20, 2013 (JP) ..... 2013-195723

(51) Int. Cl.
*G03G 5/08* (2006.01)
*G03G 5/087* (2006.01)
(Continued)

(52) U.S. Cl.
CPC ..... *G03G 5/087* (2013.01); *G03G 15/02* (2013.01); *G03G 15/0233* (2013.01); *G03G 21/18* (2013.01)

(58) Field of Classification Search
CPC ..... G03G 15/0233; G03G 15/0806; G03G 15/08018; G03G 15/2053; G03G 15/2057;
(Continued)

(56) References Cited

U.S. PATENT DOCUMENTS 5,320,042 A * 6/1994 Schwopfinger ..... B41F 22/00 101/416.1
5,610,695 A * 3/1997 Mizutani ..... G03G 15/0818 399/284
(Continued)

FOREIGN PATENT DOCUMENTS

JP 2001-229733 A 8/2001
JP 2005-128381 A 5/2005
(Continued)

OTHER PUBLICATIONS

English translation of JP 2008276023 A acquired from JPO website Jul. 20, 2016.*
(Continued)

*Primary Examiner* — Jason L Vaughan
(74) *Attorney, Agent, or Firm* — Fitzpatrick, Cella, Harper & Scinto

(57) ABSTRACT

The present invention directs to provide a charging member having a protrusion to which smear is difficult to adhere even in a long-term used, and as a result being capable of exhibiting stable charging performance. The charging member has an electro-conductive substrate and an electro-conductive surface layer, wherein the surface layer includes a binder resin and a resin particle including a plurality of electro-conductive domains inside thereof, the surface layer has a protrusion derived from the resin particle, and the electro-conductive domains are localized in the vicinity of the surface of the resin particle.

9 Claims, 5 Drawing Sheets

(51) Int. Cl.
*G03G 15/02* (2006.01)
*G03G 21/18* (2006.01)

(58) Field of Classification Search
CPC ..... G03G 15/6552; G03G 2215/00679; G03G 2215/025; G03G 2215/2058; Y10T 29/49565; Y10T 29/4956
USPC ..... 492/30, 31, 33, 35, 36, 18, 53, 56, 59
See application file for complete search history.

(56) References Cited

U.S. PATENT DOCUMENTS 6,389,254 B2 * 5/2002 Ishiyama ..... G03G 15/0233 399/174
7,835,669 B2 11/2010 Furukawa et al.
8,265,525 B2 * 9/2012 Wada ..... G03G 15/0233 399/176
8,346,132 B2 * 1/2013 Sato ..... G03G 15/0233 399/168
8,538,298 B2 9/2013 Harada et al.
8,548,359 B2 10/2013 Taniguchi et al.
8,991,053 B2 * 3/2015 Watanabe ..... B05D 5/00 29/895.3
2003/0031856 A1 2/2003 Hareyama et al.
2012/0076539 A1 3/2012 Sato et al.
2014/0270853 A1 9/2014 Uematsu et al.
2014/0308607 A1 10/2014 Taniguchi et al.
2014/0334843 A1 11/2014 Taniguchi et al.

FOREIGN PATENT DOCUMENTS

JP 2006-91185 A 4/2006
JP 2008-276023 A 11/2008
JP 2009-175427 A 8/2009
JP 2010-134452 A 6/2010
JP 5220230 B1 * 12/2012 ..... B06D 5/00

OTHER PUBLICATIONS

International Search Report dated Nov. 11, 2013 in International Application No. PCT/JP2013/005822.
International Preliminary Report on Patentability, International Application No. PCT/JP2013/005822 Mailing Date Mar. 31, 2016.

* cited by examiner

CHARGING MEMBER, METHOD OF PRODUCING THE SAME, PROCESS CARTRIDGE, AND ELECTROPHOTOGRAPHIC APPARATUS

CROSS-REFERENCE TO RELATED APPLICATIONS

This application is a continuation of International Application No. PCT/JP2013/005822, filed Sep. 30, 2013, which claims the benefit of Japanese Patent Application No. 2013-195723, filed Sep. 20, 2013.

BACKGROUND OF THE INVENTION

Field of the Invention

The present invention relates to a charging member, a method of producing the charging member, a process cartridge, and an electrophotographic apparatus.

Description of the Related Art

As a charging members used for contact electrification of a photosensitive member, it is known a charging member in which a resin particle and a graphite particle are contained in the surface layer, and having a high protrusion derived from the resin particle and a low protrusion derived from the graphite particle on the surface thereof as discharge points (Japanese Patent Application Laid-Open No. 2010-134452).

SUMMARY OF THE INVENTION

In the charging member described in Japanese Patent Application Laid-Open No. 2010-134452, the graphite particle that forms the low protrusion has high conductivity, and discharge from the low protrusion is easy to generate. For this reason, the entire charging member exhibits stable charging performance even if a toner or an external additive adheres to the high protrusion derived from the resin particle to cause difficulties in generation of discharge from the high protrusion while using.

However, as a result of further research by the present inventors, it was found that the charging member described in Japanese Patent Application Laid-Open No. 2010-134452 exhibiting stable charging performance needs to be further improvement. Namely, in the charging member described in Japanese Patent Application Laid-Open No. 2010-134452, smear hardly adheres to the low protrusion because the low protrusion does not contact a photosensitive member, which is a member to be charged of a contact charge type, in a contact region (nip) between the charging member and the photosensitive member. However, if the charging member is continuously used over a long period, smear may adhere to even the low protrusion. The low protrusion hardly contacts the electrophotographic photosensitive member. For this reason, the adhering smear is difficult to remove, leading to a tendency of accumulation of smear. As a result, the function as the discharge point of the low protrusion may degrade to prevent stable charging performance from being exhibited.

For this reason, the present inventors recognized that for more stable charging performance of the charging member, a novel technique for preventing smear from adhering to the protrusion itself of the charging member needs to be developed.

Then, the present invention is directed to providing a charging member having a protrusion to which smear is difficult to adhere even in a long-term used, and as a result being capable of exhibiting stable charging performance, and a method of producing the charging member. Further, the present invention is directed to providing a process cartridge and electrophotographic apparatus that can form a high-quality electrophotographic image.

According to one aspect of the present invention, there is provided a charging member having an electro-conductive substrate and an electro-conductive surface layer, wherein the surface layer includes a matrix including a binder resin and an electro-conductive fine particle, and a resin particle dispersed in the matrix, the charging member has a protrusion derived from the resin particle on the surface thereof, the resin particle includes a plurality of electro-conductive domains inside thereof, and the electro-conductive domains are localized in the vicinity of the surface of the resin particle.

According to another aspect of the present invention, there is provided a method of producing the charging member, comprising forming a coat of a coating solution for forming a surface layer on the electro-conductive substrate, the coating solution including a binder resin, an electro-conductive fine particle, a core-shell type porous resin particle having a pore, and a solvent, wherein an average pore diameter in a shell portion of the porous resin particle is larger than an average pore diameter in a core portion, and the average particle diameter of the electro-conductive fine particle is larger than the average pore diameter in the core portion and smaller than the average pore diameter in the shell portion.

According to further aspect of the present invention, there is provided a process cartridge detachably mountable to a main body of an electrophotographic apparatus, the process cartridge including the charging member, and an electrophotographic photosensitive member arranged in contact with the charging member. Furthermore, according to further aspect of the present invention, there is provided an electrophotographic apparatus including the charging member, and an electrophotographic photosensitive member arranged in contact with the charging member.

The present invention can provide a charging member exhibiting stable charging performance even in a long-term use, and a method of producing the charging member. Moreover, the present invention can attain a process cartridge and electrophotographic apparatus that can form a high-quality electrophotographic image over a long period.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, an embodiment according to the present invention will be described in detail.

To achieve the above objects, the present inventors studied on smear when the charging member was used. In the process, it was found that in the charging apparatus in which a superimposed voltage of DC voltage and AC voltage was applied to the charging member, as the AC voltage was increased, an insulative toner external additive was easier to adhere to the surface of the charging member. From this, it was presumed that one of factors responsible for smear adhering to the surface of the charging member was that the insulative toner external additive was electrostatically adsorbed to the surface of the charging member.

Then, to suppress the electrostatic adsorption of the toner external additive to the protrusion, the resin particle that formed the protrusion in the surface layer was focused, and further studied. As a result, it was found that smear hardly electrostatically adhered to the protrusion derived from the resin particle including a plurality of electro-conductive domains that existed in the vicinity of the surface of the resin particle.

Hereinafter, the present invention will be described using a roller-shaped charging member (hereinafter also referred to as a "charging roller") as an example. However, same effects can be expected as long as the charging member is an electrophotographic charging member for giving charge, and the present invention will not be limited to the charging roller.

Figure 1A:
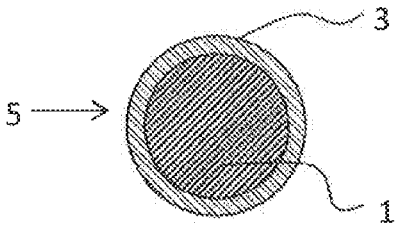
FIG. 1A is a cross sectional view illustrating an example of a charging member according to the present invention, in which a surface layer 3 is provided on an electro-conductive substrate 1.
Figure 1B:
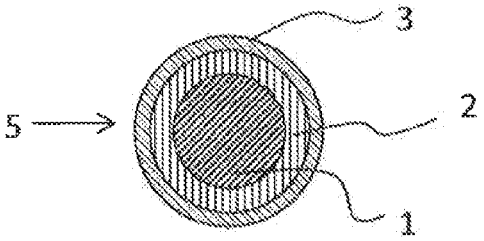
FIG. 1B is a cross sectional view illustrating an example of a charging member according to the present invention, in which an electro-conductive elastic layer 2 is provided between the electro-conductive substrate 1 and the surface layer 3.
Figure 1C:
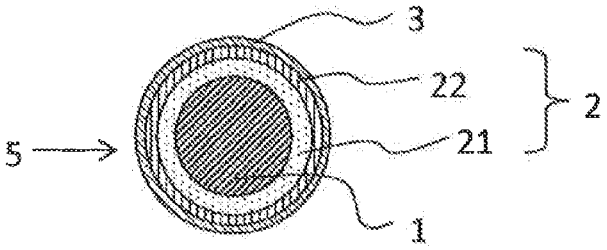
FIG. 1C is a cross sectional view illustrating an example of a charging member according to the present invention, in which an electro-conductive elastic layer 2 is provided between the electro-conductive substrate 1 and the surface layer 3.

A charging member according to the present invention will be described with reference to the drawings. FIG. 1A is a cross sectional view illustrating one example of the charging member according to the present invention. The charging member 5 has a roller shape, and includes an electro-conductive substrate 1 and an electro-conductive surface layer 3 that is a covering of the circumferential surface of the electro-conductive substrate 1. Moreover, FIGS. 1B and 1C illustrate examples in which one or more electro-conductive elastic layers 2 are provided between the electro-conductive substrate 1 and the electro-conductive surface layer 3. FIG. 1B illustrates an example of the charging member including one electro-conductive elastic layer 2 while FIG. 1C illustrates an example of the charging member including two electro-conductive elastic layers 2, that is, layers 21 and 22.

An electro-conductive adhesive layer may be provided between the electro-conductive substrate 1 and a layer laminated on thereon (such as the electro-conductive surface layer 3 in FIG. 1A, the electro-conductive elastic layer 2 in FIG. 1B, and the electro-conductive elastic layer 21 in FIG. 1C). An electro-conductive adhesive containing a known conductive agent can be used to provide the electro-conductive adhesive layer. Moreover, an electro-conductive adhesive layer may be provided between the electro-conductive elastic layer 2 (22) and the electro-conductive surface layer 3 and between the electro-conductive elastic layers 21 and 22.

Figure 2:
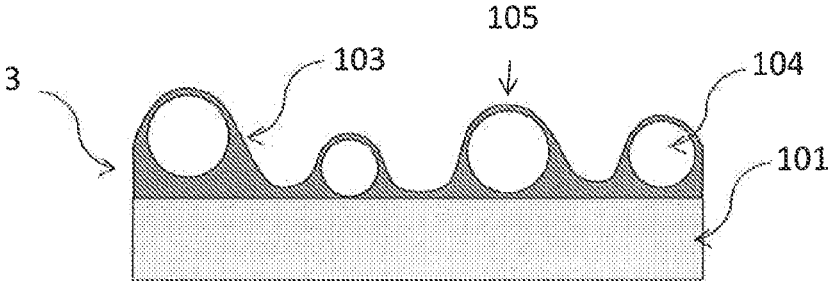
FIG. 2 is a partial cross sectional view illustrating the surface of the charging member according to the present invention.

FIG. 2 is a partial cross sectional view illustrating the vicinity of the surface of the charging member in which the laminated portion of the electro-conductive substrate (hereinafter simply referred to as a "substrate" in some cases) and the electro-conductive surface layer (hereinafter simply referred to as a "surface layer") is enlarged. A substrate 101 is covered with the surface layer 3. The surface layer 3 includes an electro-conductive matrix 103 including a binder resin and an electro-conductive fine particle (not illustrated), and a resin particle 104. A plurality of protrusions 105 each derived from the resin particle 104 are formed on the surface of the surface layer.

Figure 3:
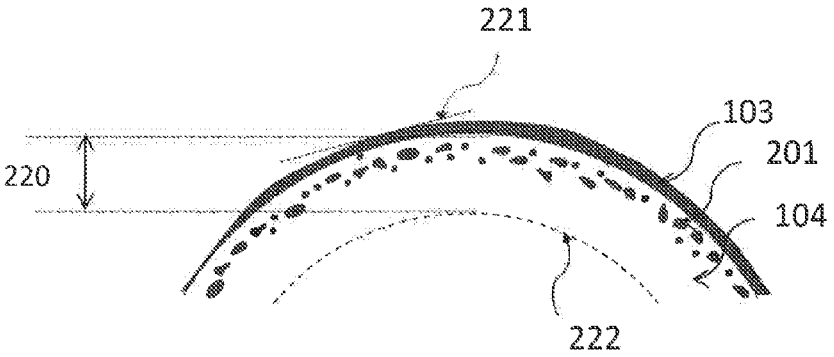
FIG. 3 is an enlarged cross sectional view of a vertex of a protrusion in the charging member according to the present invention.

FIG. 3 is an enlarged cross sectional view illustrating the vicinity of the vertex of the protrusion. In the present invention, the resin particle 104 in the surface layer 3 includes a plurality of electro-conductive domains 201 inside thereof. The electro-conductive domains 201 are localized in the vicinity of the surface of the resin particle 104.

In the present invention, localization of the electro-conductive domain 201 in the vicinity of the surface of the resin particle 104 is defined as follows. Namely, assuming that the resin particle is solid (hereinafter also referred to as a "solid resin particle"), a circle having an area equal to the area of the cross section passing through the center of gravity of the solid resin particle is determined, and its concentric circle whose diameter is 0.8 times the length of the diameter of the above-determined circle is also determined. The area of a portion between the circle and the concentric circle having a doughnut shape is determined. Next, in the cross section passing through the center of gravity of the solid resin particle, a region surrounded by the surface of the solid resin particle and a line equally spaced from the surface (a dotted line 222 in FIG. 3) is defined so that the region have an area equal to that of the doughnut-shaped portion. Then, the case where the region includes more than 50% of the electro-conductive domain 201 appearing in the cross section (based on the number of electro-conductive domains) is defined as the localization of the electro-conductive domain 201 in the vicinity of the surface of the resin particle 104.

Moreover, the electro-conductive domain 201 refers to a region in which the concentration of the electro-conductive fine particle existing in the resin particle that forms the protrusion on the surface of the surface layer is higher than the concentration of the electro-conductive fine particle in the matrix 103 in the surface layer. Moreover, the resin particle 104 is contained in the matrix 103 including a binder resin and an electro-conductive fine particle dispersed in the binder resin.

Furthermore, the electro-conductive domain 201 is electrically conducted to the matrix 103, but is in a state as if the electro-conductive domain 201 is isolated as illustrated in FIG. 3. For this reason, the electro-conductive domain 201 is in a state where charge is easy to keep.

The present inventors presume the reason why the charging member according to the present invention suppresses adhesion of smear to the protrusion as follows.

Figure 4A:
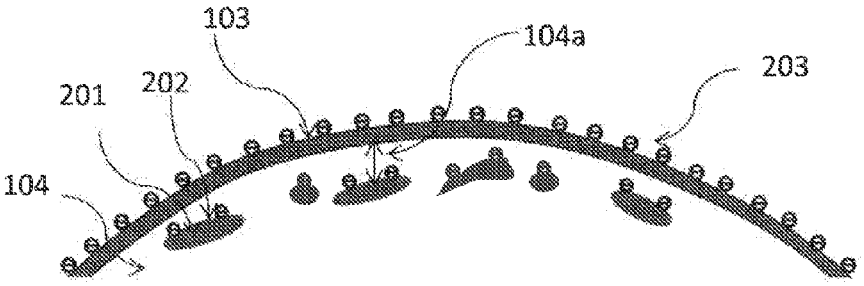
FIG. 4A is an enlarged cross sectional view for describing the charging state in the surface of the protrusion before and after discharge when a minus voltage is applied to the charging member according to the present invention.
Figure 4B:
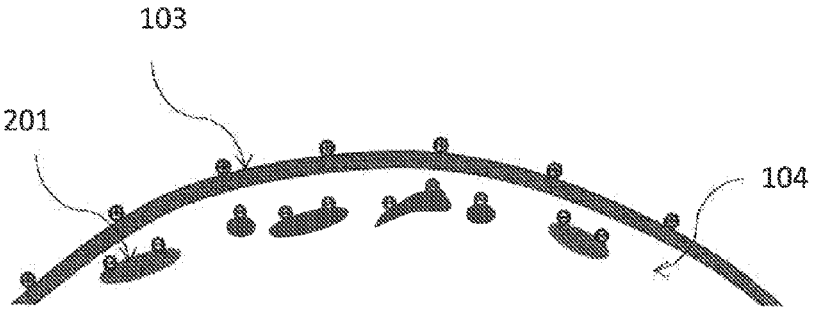
FIG. 4B is an enlarged cross sectional view for describing the charging state in the surface of the protrusion before and after discharge when a minus voltage is applied to the charging member according to the present invention.

Typically, to prevent leak even if the member to be charged such as the electrophotographic photosensitive member has pin holes, the charging member used for contact charge includes a surface layer having a volume resistivity of approximately $1.0\times10^{3}$ to $1.0\times10^{13}$ Ω·cm in an environment of a temperature of 23° C. and a relative humidity of 50%, for example. For this reason, in charging of the member to be charged, charge is discharged from the surface of the charging member by discharging. At the moment, the charge having a polarity opposite to the polarity of the applied voltage in discharging is accumulated in the surface of the charging member. This is described using FIGS. 4A and 4B. FIGS. 4A and 4B are diagrams for describing the state of charge in the vicinity of the vertex portion of the protrusion 105.

FIG. 4A is a diagram illustrating the state where minus charge is accumulated in the surface of the charging member when the DC voltage superimposed on the AC voltage is applied between the charging member 5 and the member to be charged (not illustrated). At this time, the minus charge is also accumulated in the surface of the electro-conductive domain 201.

To negatively charge the member to be charged by the charging member, the charge density in the surface of the charging member becomes plus immediately after charge is discharged from the surface of the charging member to the surface of the member to be charged (FIG. 4B). This is because the surface layer in the charging member used for contact charge has an electric resistance of approximately $1.0\times10^{3}$ to $1.0\times10^{13}$ Ω·cm in terms of the volume resistivity as described above, and a certain amount of time is needed to recharge the surface of the charging member after the minus charge is discharged by discharging.

In contrast, discharging instantly occurs in a short time. For this reason, the minus charge accumulated in the interface between the resin that forms the resin particle 104 and the electro-conductive domain 201 is kept (FIG. 4B).

For this reason, the charge accumulated in the surface of the vertex of protrusion in the charging member and the charge accumulated in the electro-conductive domain 201 are inverted immediately after the discharging. Namely, an inverted electric field is formed in the vicinity of the vertex of protrusion in the charging member. As a result, the smear electrostatically adsorbed to the protrusion in the surface of the charging member receives a force to remove from the protrusion by the formation of the inverted electric field. Thereby, adhesion of the smear to the vertex of the protrusion in the charging member is suppressed.

The inverted electric field is formed every time when discharge from the charging member is performed to charge the member to be charged, and the electrostatic effect of removing the smear is produced. For this reason, the adhesion of the smear to the surface of the charging member can be effectively suppressed even in the conventional charging method, particularly the charging method of applying AC charge in which it is thought that the charging member is easy to become dirty.

In the present invention, the electro-conductive domains 201 need to be localized in the vicinity of the surface of the resin particle. If the electro-conductive domains 201 exist even in the inside of the resin particle, the charge that can be kept by the resin particle is spread over the entire resin particle. As a result, the intensity of the inverted electric field formed immediately after the discharging described above weakens in the surface of the protrusion of the charging member. As a result, the effect of removing the smear electrostatically adhering to the protrusion reduces.

For this reason, the electro-conductive domains localized in the surface of the resin particle can exit within a region corresponding to approximately 10% of the diameter of the resin particle from the surface of the resin particle. Although described later, the thickness of the region 220 in which the electro-conductive domains localized in the surface of the resin particle exists is referred to as an electro-conductive domain region width.

The volume average particle diameter of the resin particle included in the surface layer in the charging member is preferably 5 to 60 μm, and particularly more preferably 15 to 40 μm. At a volume average particle diameter within this range, the protrusion derived from the resin particle and formed on the surface layer has a proper height, and serves as a good discharge point.

To enhance the effect of suppressing the adhesion of the smear to the protrusion, the inverted electric field can be enhanced, namely, charge can be intensively kept in the vicinity of the surface of the resin particle on the vertex side of protrusion side in the charging member in which the vertex of the protrusion serves as the discharge point.

Here, when voltage is applied to the charging member, the electric field is formed in the direction intersecting perpendicular to a tangent 221 of the surface of the protrusion in the cross section of the protrusion as illustrated in FIG. 3 (see FIG. 3). For this reason, the electro-conductive domains can be formed in the resin particle such that an interface 202 between the insulation portion 104*a* in the vicinity of the surface and the electro-conductive domain 201 intersects the direction of the electric field.

Moreover, the diameter of the electro-conductive domain in the cross section of the resin particle can be 5 to 50% of the electro-conductive domain region width described later. Moreover, the proportion of the electro-conductive domain included in the electro-conductive domain region can be 10 to 50% of the area of the electro-conductive domain region. A proportion within this range enables a sufficient amount of the interface in which charge is accumulated. Moreover, the state where charge is easy to accumulate in the interface, namely, the state where the electro-conductive domain is easy to keep charge in the discharging is easily attained.

The thickness of the matrix that is the covering of the resin particle, namely, the distance between the electro-conductive domain inside of the resin particle and the outermost surface of the charging member gives an influence on the strength of the inverted electric field. Specifically, as the distance is smaller, the inverted electric field is stronger and the effect of suppressing the adhesion of the smear to the protrusion is larger. If the thickness of the matrix is excessively thin, charge is difficult to accumulate in the surface of the protrusion in the charging member. Then, to ensure functioning of the protrusion as the discharge point, the thickness of the matrix that is the covering of the resin particle is preferably 0.1 to 2.0 μm, and particularly 0.4 to 1.0 μm.

<Electro-Conductive Surface Layer>

The electro-conductive surface layer according to the present invention includes a matrix including a binder resin and electro-conductive fine particle dispersed in the binder resin, and a resin particle dispersed in the matrix. The surface of the surface layer has the protrusion derived from the resin particle. Furthermore, the resin particle includes the electro-conductive domain inside thereof, and the electro-conductive domains are localized in the vicinity of the surface of the resin particle. Hereinafter, the components will be described.

[Binder Resin]

As the binder resin used for the surface layer, known binder resins used in production of the charging member can be used. For example, thermosetting resin and thermoplastic resin can be used. Among these, fluorinated resin, polyamide resin, acrylic resin, polyurethane resin, acrylic urethane resin, silicone resin, and butyral resin are preferable. These may be used alone or in combination by mixing. Moreover, raw material monomers for these resins may be copolymerized, and used as copolymers.

[Electro-Conductive Fine Particle]

In the present invention, the surface layer contains the following electro-conductive fine particle to control the volume resistivity of the surface layer to be approximately $1.0\times10^{3}$ to $1.0\times10^{13}$ Ω·cm under an environment of a temperature of 23° C. and a relative humidity of 50%. Specific examples of the electro-conductive fine particle include:

- fine particles of metals such as aluminum, palladium, iron, copper, and silver;
- fine particles of metal oxides such as titanium oxide, tin oxide, and zinc oxide; and
- carbon black and carbon fine particles.

Moreover, composite fine particles obtained by surface treating the surfaces of the metallic fine particles and metal oxides by electrolysis, spray coating, or mixing and shaking can also be used as the electro-conductive fine particle.

These electro-conductive fine particles can be used alone or in combination of two or more. When the electro-conductive fine particle is carbon black, the electro-conductive fine particle may be an electro-conductive composite fine particle obtained by covering metal oxide with carbon black. As described later, the electro-conductive fine particle is also a component that condenses in the porous resin particle to form the electro-conductive domain inside of the resin particle. The average particle diameter (volume average particle diameter, or arithmetic average particle diameter) of the primary particle of the electro-conductive fine particle is preferably 10 to 100 nm, and particularly preferably 12 to 50 nm.

[Resin Particle]

The resin particle according to the present invention forms the protrusion on the surface layer.

For the material, acrylic resin, styrene resin, acrylonitrile resin, vinylidene chloride resin, and vinyl chloride resin can be used, for example. These resins can be used alone or in combination of two or more. Furthermore, copolymers prepared by properly selecting and copolymerizing raw material monomers for these resins may be used. Moreover, these resins may be used as the main component, and other known resins may be contained when necessary.

The resin particle existing in the surface layer in the charging member according to the present invention to form the protrusion on the surface of the charging member includes a plurality of electro-conductive domains inside thereof. The electro-conductive domains are localized in the vicinity of the surface of the resin particle.

To obtain such a charging member, a porous resin particle can be used as the resin particle contained in the coating solution used for forming the surface layer (hereinafter also referred to as a "coating solution for forming a surface layer"). Here, the porous resin particle refers to a resin particle having a pore penetrating through the surface (hereinafter also referred to as a "through hole"). Among these, an effective porous resin particle in use is a porous resin particle having a through hole both in the core portion and the shell portion in which the pore diameter in the core portion is relatively smaller than the pore diameter in the shell portion. The reason why by use of such a porous resin particle, the electro-conductive domain that can keep charge in discharging from the charging member can be localized in the vicinity of the surface of the resin particle in the surface layer, will be described later.

To localize a plurality of electro-conductive domains in the vicinity of the surface of the resin particle, it is important to control of the pore diameter of the porous resin particle. Hereinafter, the porous resin particle according to the present invention will be described in detail.

The porous resin particle according to the present invention can be produced by a known production method such as a suspension polymerization method, interface polymerization method, an interface precipitation method, a liquid drying method, or a method of adding a solute or solvent for reducing the solubility of the resin to the resin solution to precipitate the resin.

For example, in the suspension polymerization method, a porosifying agent is dissolved in a polymerizable monomer in the presence of a crosslinkable monomer to prepare an oily mixed solution. The oily mixed solution is subjected to aqueous suspension polymerization in an aqueous medium containing a surfactant and a dispersion stabilizer. After the polymerization is completed, water and the porosifying agent are removed by washing and drying. Thereby, a porous resin particle can be obtained. A compound having a reactive group reactive with a functional group in the polymerizable monomer and an organic filler can also be added. Moreover, to form a pore inside of the particle, polymerization is performed in the presence of a crosslinkable monomer.

Examples of the polymerizable monomer include: styrene monomers such as styrene, p-methylstyrene, p-tert-butylstyrene; and (meth)acrylic acid ester monomers such as methyl acrylate, ethyl acrylate, propyl acrylate, butyl acrylate, 2-ethylhexyl acrylate, lauryl acrylate, methyl methacrylate, ethyl methacrylate, propyl methacrylate, butyl methacrylate, isobutyl methacrylate, tert-butyl methacrylate, benzyl methacrylate, phenyl methacrylate, isobornyl methacrylate, cyclohexyl methacrylate, glycidyl methacrylate, hydrofurfuryl methacrylate, and lauryl methacrylate. These polymerizable monomers are used alone or in combination of two or more. In the present invention, the term (meth)acrylic is a concept including both acrylic and methacrylic.

The crosslinkable monomer is not particularly limited as long as the crosslinkable monomer has a plurality of vinyl groups, and examples thereof can include: (meth)acrylic acid ester monomers such as ethylene glycol di(meth)acrylate, diethylene glycol di(meth)acrylate, triethylene glycol di(meth)acrylate, decaethylene glycol di(meth)acrylate, pentadecaethylene glycol di(meth)acrylate, pentacontahectaethylene glycol di(meth)acrylate, 1,3-butylene glycol di(meth)acrylate, 1,4-butanedioldi(meth)acrylate, 1,6-hexanediol di(meth)acrylate, glycerin di(meth)acrylate, allyl methacrylate, trimethylolpropane tri(meth)acrylate, pentaerythritoltetra(meth)acrylate, phthalic acid diethylene glycol di(meth)acrylate, caprolactone-modified dipentaerythritol hexa(meth)acrylate, caprolactone-modified hydroxy pivalic acid ester neopentyl glycol diacrylate, polyester acrylate, and urethane acrylate; divinylbenzene, divinylnaphthalene, and derivatives thereof. These can be used alone or in combination.

The crosslinkable monomer can be used in the range of 5 to 90% by mass in the monomer. Within this range, a pore can be surely formed inside of the particle.

As the porosifying agent, non-polymerizable solvents, mixtures of a linear polymer dissolved in a polymerizable monomer mixture and a non-polymerizable solvent, and cellulose resin can be used. Examples of the non-polymerizable solvent can include toluene, benzene, ethyl acetate, butyl acetate, normal hexane, normal octane, and normal dodecane. The cellulose resin is not particularly limited, and examples thereof can include ethylcellulose.

The amount of the porosifying agent to be added can be properly selected according to the purpose of use. The porosifying agent can be used in the range of 20 to 90 parts by mass in 100 parts by mass of an oil phase including the polymerizable monomer, the crosslinkable monomer, and the porosifying agent. At an amount within this range, the porous resin particle can be prevented from becoming fragile. As a result, the porous resin particle can function as the discharge point over a long period without deforming or lacking in the nip between of the charging member and the electrophotographic photosensitive member.

The polymerization initiator is not particularly limited. A polymerization initiator soluble in the polymerizable monomer can be used. Known peroxide initiators and azo initiators can be used. Examples of the azo initiator can include: 2,2'-azobisisobutyronitrile, 1,1'-azobiscyclohexane 1-carbonitrile, 2,2'-azobis-4-methoxy-2,4-dimethylvaleronitrile, and 2,2'-azobis-2,4-dimethylvaleronitrile.

Examples of the surfactant can include: anionic surfactants such as sodium lauryl sulfate, polyoxyethylene (polymerization degree: 1 to 100), and lauryl sulfate triethanolamine; cationic surfactants such as stearyltrimethylammonium chloride, stearic acid diethylaminoethylamide lactic acid salt, dilaurylaminehydrochloric acid salt, and oleylaminelactic acid salt; nonionic surfactants such as adipic acid diethanolamine condensates, lauryldimethylamine oxide, glycerol monostearate, sorbitan monolaurate, and stearic acid diethylaminoethylamide lactic acid salt; amphoteric surfactants such as palm oil fatty acid amide propyldimethylaminoacetic acid betaine, laurylhydroxysulfobetaine, and sodium β-laurylaminopropionate; and high molecular dispersants such as polyvinyl alcohol, starch, and carboxymethylcellulose.

Examples of the dispersion stabilizer can include: organic fine particles such as polystyrene fine particles, polymethyl methacrylate fine particles, polyacrylic acid fine particles, and polyepoxide fine particles; silica such as colloidal silica; calcium carbonate, calcium phosphate, aluminum hydroxide, barium carbonate, and magnesium hydroxide.

Among the polymerization methods, particularly a specific example of the suspension polymerization method will be described below. The suspension polymerization can be performed under a sealing condition using a pressure-resistant container. Prior to the polymerization, the raw material component may be suspended with a dispersing machine, the suspension may be placed in a pressure-resistant container and suspension polymerized; or the reaction solution may be suspended in a pressure-resistant container and polymerized. The polymerization temperature can be 50 to 120° C. The polymerization may be performed under atmospheric pressure. To prevent the porosifying agent from becoming gaseous, the polymerization can be performed under increased pressure (under a pressure atmospheric pressure plus 0.1 to 1 MPa). After the polymerization is completed, solid liquid separation and washing may be performed by centrifugation or filtering. After solid liquid separation and washing, the obtained product may be dried or crushed at a softening temperature or less of the resin that forms the porous resin particle. Drying and crushing can be performed by a known method, and an air dryer, a fair wind dryer, and a Nauta Mixer can be used. Moreover, drying and crushing can be performed at the same time with a crusher dryer. The surfactant and the dispersion stabilizer can be removed by repeating washing and filtering after production.

The particle diameter of the porous resin particle can be adjusted according to the mixing conditions for the oily mixed solution including the polymerizable monomer and the porosifying agent and the aqueous medium containing the surfactant and the dispersion stabilizer, the amount of the dispersion stabilizer to be added, and the stirring and dispersing conditions. If the amount of the dispersion stabilizer to be added is increased, the average particle diameter can be decreased. Moreover, if the stirring rate, which is one of the stirring and dispersing conditions, is increased, the average particle diameter of the porous resin particle can be decreased. The volume average particle diameter of the porous resin particle as the raw material for the resin particle according to the present invention is preferably in the range of 5 to 60 μm, and particularly preferably 15 to 45 μm. At a volume average particle diameter within this range, a protrusion that can stably function as the discharge point can be formed on the surface of the charging member.

Moreover, the pore diameter, the inner pore diameter, and the proportion of the region containing air of the porous resin particle can be adjusted according to the amount of the crosslinkable monomer to be added, and the kind and amount of the porosifying agent to be added.

The pore diameter can be adjusted by increasing or decreasing the amount of the porosifying agent to be added based on the polymerization monomer. Moreover, the pore diameter can be adjusted by increasing or decreasing the amount of the crosslinkable monomer to be added. The pore diameter will increase by increasing the amount of the porosifying agent or by decreasing the amount of the crosslinkable monomer to be added. Moreover, when the pore diameter is further increased, this can be attained by using cellulose resin as the porosifying agent.

The above-mentioned porous resin particle having a core-shell structure in which the pore diameter in the shell portion is larger than the pore diameter in the core portion can be produced by using two porosifying agents, particularly two porosifying agents having different solubility parameters (hereinafter referred to as an "SP value").

As a specific example, an example in which normal hexane and ethyl acetate are used as the porosifying agents will be described below. When the two porosifying agents are used and the oily mixed solution of the polymerizable monomer and the porosifying agents is added to an aqueous medium, a large amount of the ethyl acetate having an SP value close to that of water used as the medium exist on the aqueous medium side, namely, on the outer side of suspended droplets.

In contrast, a larger amount of normal hexane exists inside of the droplets. The ethyl acetate existing on the outer side of the droplets has an SP value close to that of water, and therefore water is dissolved in the ethyl acetate in a certain degree. In this case, the solubility of the porosifying agent in the polymerizable monomer is lower in the outer side of the droplets than in the inside of the droplets. As a result, the polymerizable monomer is separated from the porosifying agents more easily than in the inside of the droplets. Namely, the porosifying agent is more likely to exist as a larger bulk in the outer side of the droplets than in the inside of the droplets.

Thus, the polymerization reaction, and a post treatment are performed in the state where the porosifying agents are controlled to exist in the inside of the droplets differently from the outer side of the droplets. Thereby, the porous resin particle having a pore diameter in the outer portion larger than that in the inner portion can be produced. Moreover, the pore diameter in the outer side of the droplet, which becomes the shell portion, can be adjusted according to the SP value of the porosifying agent in the outer side of the droplets. Moreover, the thickness of the shell portion of the porous resin particle finally obtained can be adjusted according to the ratio of the two porosifying agents to be used.

Accordingly, if one of the two porosifying agents to be used is the porosifying agent having an SP value close to that of water used as the medium, the pore diameter in the outer portion (shell portion) of the porous resin particle can be increased and the porosity therein can be increased. For the porosifying agent to be used in this method, ethyl acetate, methyl acetate, propyl acetate, acetic acid isopropyl, butyl acetate, acetone, and methyl ethyl ketone can be used, for example. If the other porosifying agent to be used has high solubility in the polymerizable monomer and the difference in the SP value between the porosifying agent and water is larger, the pore diameter in the inner portion of the porous resin particle can be reduced and the porosity therein can be reduced. In this method, a porosifying agent such as normal hexane, normal octane, and normal dodecane can be used.

Moreover, the regions having different pore diameters can be controlled according to the ratio of the porosifying agents to be used. In the present invention, as described above, the above particle is used for the electro-conductive domain to intensively concentrate in the vicinity of the vertex of the protrusion formed on the surface of the charging member. From this viewpoint, the amount of the porosifying agent having an SP value close to that of water is preferably 50 parts by mass or less based on 100 parts by mass of the porosifying agents in total. The amount is more preferably 15 to 25 parts by mass.

To form the electro-conductive domain according to the present invention, the resin particle contained in the coating solution for forming a surface layer can be a resin particle having a core-shell structure, having the pore (through hole) in both the core portion and the shell portion, and having the average pore diameter in the core portion smaller than the average pore diameter in the shell portion.

Figure 5:
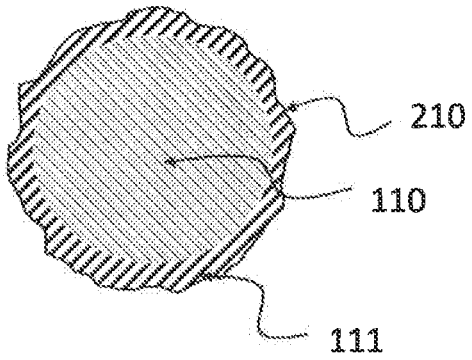
FIG. 5 is a schematic cross sectional view illustrating a porous resin particle according to the present invention.

FIG. 5 is a schematic cross sectional view illustrating the porous resin particle. The porous resin particle 210 includes a core portion 110 having a relatively small pore and a shell portion 111 having a relatively large pore in the vicinity of the surface of the particle. Namely, the porous resin particle used to form the protrusion on the surface layer in the present invention means a particle in which the pore in the shell portion 111 in the vicinity of the surface of the particle is larger than the pore in the core portion 110 in the vicinity of the central portion of the particle.

Moreover, the average pore diameter in the core portion can be 10 to 50 nm and that in the shell portion is suitably 40 to 500 nm. The largest pore diameter is preferably 5% or less of the volume average particle diameter of the porous resin particle. Furthermore, the average pore diameter in the core portion is preferably 15 nm or more and 40 nm or less, and that in the shell portion is preferably 50 to 200 nm. The largest pore diameter is more preferably 1% or less of the volume average particle diameter of the porous resin particle. Within these ranges, the resin particle can exhibit the functionality as the discharge point stably even in long-term use without lacking in the nip portion between the charging member and the electrophotographic photosensitive member.

The method for determining the core portion and the shell portion is as follows.

First, the porous resin particle is embedded using a photocurable resin such as visible light-curable embedding resins (trade name: D-800, made by Nisshin EM Corporation, trade name: Epok812 Set, made by Okenshoji Co., Ltd.). Next, after trimming is performed using a diamond knife "DiATOME CRYO DRY" (trade name, made by Diatome AG), the center of the porous resin particle (to include a portion in the vicinity of the center of gravity 301 illustrated in FIG. 6) is cut out to form a section having a thickness of 100 nm. The cut out is performed by mounting the diamond knife on an ultramicrotome "LEICA EM UCT" (trade name, made by Leica) or a cryosystem "LEICA EM FCS" (trade name, made by Leica).

The cut-out section is dyed with any one of dyeing agents selected from osmium tetroxide, ruthenium tetraoxide, and phosphorus tungstate, and cross sectional images of 100 porous resin particles are photographed with a transmission electron microscope "H-7100FA" (trade name, made by Hitachi, Ltd.). At this time, the resin portion is observed in white, and the pore portion into which the embedding resin invades is observed in black. A combination of the embedding resin and the dyeing agent are properly selected according to the material for the porous resin particle to clearly see the pore of the porous resin particle. For example, the pore can be clearly seen in the porous resin particle A1 produced in Production Example A1 described later by using the "visible light-curable embedding resin D-800" (trade name) and ruthenium tetraoxide.

Figure 6:
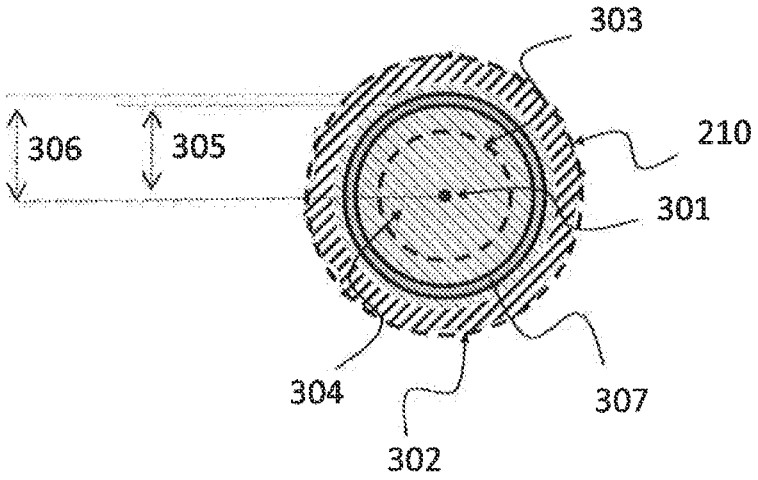
FIG. 6 is a schematic view illustrating a cross sectional image photographing with a transmission electron microscope, in which shapes of the core and the shell of the porous resin particle according to the present invention are illustrated.

The cross sectional image of the particle is defined as illustrated in FIG. 6.

In FIG. 6, a center of gravity 301 is defined as center of gravity when the area of the region including the pore portion in the porous resin particle is calculated and it is assumed that the porous resin particle is a solid particle. A circle 302 is defined as a circle having the center of gravity 301 as the center of the circle and having an area equal to that of the region. Next, a circle 303 is defined as a circle having the center of gravity 301 as the center of the circle and having ½ of the diameter of the circle 302, and an inner side of the circle 303 is defined as an inner region 304. In the cross sectional image, the proportion of the total area of the pore portion in the inner region to the total area of the region including the pore portion in the inner region 304 is calculated. This is defined as a central portion porosity.

Next, concentric circles having a radius 100 nm larger than that of the circle 303 are sequentially formed toward the outer side of the inner region. The radius of one of the circles is defined as a radius 305, and the radius of an outer circle next to the circle having the radius 305 is defined as a radius 306. A region surrounded by the radius 305 and the radius 306 is defined as an outer shell region 307. In the cross sectional image, the proportion of the total area of the pore portion in the outer shell region to the total area of the region including the pore portion in the outer shell region 307 is defined as an outer shell region porosity.

The outer shell region porosity is sequentially calculated for every circle in which the radius of the circle increases in increments of 100 nm toward the outer side of the circle 303. When the outer shell region porosity reaches 1.2 times or more as much as the central portion porosity for the first time, the inner side of the radius 305 is defined as the core portion, and the outer side thereof is defined as the shell portion.

[Other Components]

The electro-conductive surface layer according to the present invention may contain an insulation particle in addition to the electro-conductive fine particle. Examples of the insulation particle can include: particles of zinc oxide, tin oxide, indium oxide, titanium oxides (such as titanium dioxide and titanium monoxide), iron oxide, silica, alumina, magnesium oxide, zirconium oxide, strontium titanate, calcium titanate, magnesium titanate, barium titanate, calcium zirconate, barium sulfate, molybdenum disulfide, calcium carbonate, magnesium carbonate, dolomite, talc, kaolin clay, mica, aluminum hydroxide, magnesium hydroxide, zeolite, wollastonite, diatomite, glass beads, bentonite, montmorillonite, hollow glass balls, organometallic compounds, and organometallic salts. Moreover, iron oxides such as ferrite, magnetite, and hematite and activated carbon can be used.

To improve releasing properties, the electro-conductive surface layer may further contain a mold release agent. The mold release agent contained in the electro-conductive surface layer can prevent smear from adhering to the surface of the charging member and improve the durability of the charging member. When the mold release agent is a liquid, the mold release agent also acts as a leveling agent when the electro-conductive surface layer is formed.

Moreover, the electro-conductive surface layer may be subjected to surface finishing using UV or an electron beam or surface modification by applying a compound to the surface and/or impregnating the surface with a compound.

(Formation of Electro-Conductive Surface Layer)

The electro-conductive surface layer according to the present invention can be formed by an electrostatic spray coating method, a dipping coating method, and a brush coating method, for example. Moreover, a electro-conductive sheet or tube produced in advance to have a predetermined film thickness is bonded to or covered with a substrate material or an electro-conductive elastic layer. Thereby, the electro-conductive surface layer can also be formed. Furthermore, a film may be molded in a mold with a material for forming a surface layer, and a substrate may be inserted. Then, an electro-conductive elastic layer may be formed. Among these, the method of applying the coating solution by the coating method to form a coat is preferable.

When the electro-conductive surface layer is formed by the coating method, the solvent used for the coating solution may be any solvent that can dissolve the binder resin. Specifically, examples of the solvent can include: alcohols such as methanol, ethanol, and isopropanol; ketones such as acetone, methyl ethyl ketone, and cyclohexanone; amides such as N,N-dimethylformamide and N,N-dimethylacetamide; sulfoxides such as dimethyl sulfoxide; ethers such as tetrahydrofuran, dioxane, dibutyl ether, and ethylene glycol dimethyl ether; cellosolves such as ethylene glycol monomethyl ether; esters such as methyl acetate, ethyl acetate, and butyl acetate; and aromatic compounds such as toluene, xylene, chlorobenzene, and dichlorobenzene.

As the method of dispersing the binder resin, the electro-conductive fine particle, and the like in the coating solution, a known dispersing method such as a ball mill, a sand mill, a paint shaker, a DYNO-MILL, and a pearl mill can be used.

When the core-shell type porous resin particle is used, the binder resin and the electro-conductive fine particle invade into the pores of the porous resin particle in the coating solution for forming a surface layer. However, the pore diameter in the core portion of the porous resin particle is smaller than the pore diameter of the pore in the shell portion. For this reason, the binder resin can invade into the pore in the core portion easily while the electro-conductive fine particle is difficult to invade into there.

Namely, in the process of invasion of the coating solution for forming a surface layer containing the binder resin and the electro-conductive fine particle into the pore in the porous resin particle, the electro-conductive fine particle is filtered out at the pore in the shell portion and hardly invades into the pore in the core portion while the binder resin invades into the core portion. Thereby, the electro-conductive fine particle is richly filled into the pores in the shell portion of the porous resin particle.

Moreover, the pore of the porous resin particle produced by the above method has a very complicated shape. The electro-conductive fine particle passes through micropores in communication with the surface of the porous resin particle and enters the inside of the porous resin particle. For this reason, the region inside of the particle into which the electro-conductive fine particle is taken and condensed, namely, the electro-conductive domain is not completely isolated electrically inside of the resin particle. Namely, the electro-conductive domain is electrically conducted to the matrix. However, as illustrated in FIG. 3, the electro-conductive domain is in a state as if the electro-conductive domain is isolated in any cross section passing through the central portion of the particle. For this reason, the electro-conductive domain is easy to keep charge. Thus, use of the core-shell type porous resin particle above can easily attain the state where the electro-conductive domains (regions in which the electro-conductive fine particles invading into the pores of the porous resin particle is condensed) are localized in the surface of the resin particle.

To form the above electro-conductive domain to be localized in the surface of the resin particle, the average pore diameter in the shell portion of the porous resin particle is preferably larger than the volume average particle diameter of the electro-conductive fine particle, and more preferably larger twice or more than the average particle diameter of the electro-conductive fine particle. At an average pore diameter within this range, the electro-conductive fine particle permeates into the pore in the shell portion more smoothly. Moreover, the average pore diameter in the shell portion can be 50% or less of the thickness of the shell portion. At an average pore diameter within this range, the electro-conductive domain as described above is easy to form. Namely, the electro-conductive domains are localized in the vicinity of the surface of the resin particle, and easy to keep charge in discharging.

Furthermore, the shell portion preferably has an average porosity of 10% by volume or more and 50% by volume or less. The average porosity is more preferably 20% by volume or more and 40% by volume or less. At an average porosity within this range, the electro-conductive domain as described above is easy to form. Namely, the electro-conductive domains easy to keep charge in discharging are localized on the particle surface side.

The average pore diameter in the core portion of the porous resin particle is preferably smaller than the average particle diameter of the electro-conductive fine particle, and more preferably ½ or less of the average particle diameter of the electro-conductive fine particle. At a average pore size within this range, the electro-conductive fine particle permeating into the core portion decreases. As a result, the presence of the electro-conductive domain easily concentrates only in the vicinity of the particle surface. Actually, the micropowder of the electro-conductive fine particle exists, and therefore the electro-conductive fine particle permeating into the core portion can exist as the micropowder. If the average pore diameter in the core portion is small, the electro-conductive fine particle having a large particle diameter blocks the pore openings in the core portion because of the flow of the binder resin permeating into the core portion. For this reason, the micropowder of the electro-conductive fine particle hardly gives any influence. Moreover, at an average pore diameter in the core portion of 10 nm or more, the binder resin easily permeates into the core portion. The flow of the binder resin promotes blocking of the pore openings by the electro-conductive fine particle having a large particle diameter. For this reason, the presence of the electro-conductive domain is more limited to the surface of the particle, and a more stable smear preventing effect can be exhibited.

Moreover, the average porosity in the core portion is preferably 5% by volume or more and 50% by volume or less. The average porosity in the core portion is more preferably 10% by volume or more and 40% by volume or less. At an average porosity within this range, the binder resin stably flows into the core portion, and the protrusion as the discharge point is stably kept without lacking in the nip portion with the photosensitive member.

Namely, a coating material for forming a surface layer including (i) to (iv) below can be used to form the surface layer according to the present invention.

(i) A binder resin or a binder resin raw material, (ii) the core-shell type porous resin particle having the pore in both the core portion and the shell portion, and having an average pore diameter in the shell portion larger than the average pore diameter in the core portion, (iii) the electro-conductive fine particle having an average particle diameter larger than the average pore diameter in the core portion and smaller than the average pore diameter in the shell portion, and (iv) a solvent that can dissolve or disperse (i) to (iii) above.

A specific example of the method of forming the surface layer will be described below.

First, disperse components other than the porous resin particle such as the electro-conductive fine particle and a solvent with glass beads having a diameter of 0.8 mm are mixed with the binder resin, and the mixture is dispersed over 5 hours to 60 hours using a paint shaker dispersing machine. Next, the porous resin particle is added, and dispersed. The dispersion time can be 2 minutes or more and 30 minutes or less. Here, conditions need to be set not to crush the porous resin particle. Subsequently, the viscosity is adjusted to be 3 to 30 mPa·s, and more preferably 3 to 20 mPa·s to obtain a coating solution for a surface layer. Next, a coating is formed on the electro-conductive substrate or the electro-conductive elastic layer by dipping or the like such that the thickness of the surface layer is 0.5 to 50 μm, more preferably 1 to 20 μm, and particularly preferably 1 to 10 μm. Next, the coating is dried and cured to form a surface layer.

The thickness of the surface layer means the thickness of the matrix 103 in a portion in which no protrusion derived from the resin particle 104 is formed. Moreover, the thickness of the surface layer can be measured by cutting out the cross section of the charging member with a sharp knife and observing the cross section with an optical microscope or an electron microscope. In the present invention, any three points in the longitudinal direction of the charging member× three points in the circumferential direction thereof, nine points in total are measured, and the average value is defined as the thickness.

Moreover, if the coating solution for forming a surface layer including the (i) to (iii) is used to form the surface layer, the protrusion derived from the resin particle is formed on the surface of the surface layer by drying the coat of the coating solution for forming a surface layer and curing which is performed when necessary.

The ten-point average roughness (Rzjis) of the charging member surface is preferably 8.0 to 100.0 μm, and particularly preferably 12.0 to 60.0 μm. Moreover, the average interval between the concavity and the protrusion (Rsm) is preferably 20 to 300 μm, and particularly preferably 50 to 200 μm. At Rzjis and Rsm within this range, gaps are easy to form in the nip with the electrophotographic photosensitive member, and discharge within the nip can be stably performed.

The ten-point average roughness and the average interval between the concavity and the protrusion are measured according to the standard of JIS B0601-1994 surface roughness using a surface roughness measuring apparatus "SE-3500" (trade name, made by Kosaka Laboratory Ltd.). Any six places in the charging member are measured for the ten-point average roughness, and the average value thereof is defined as the ten-point average roughness. Moreover, the average interval between the concavity and the protrusion is determined as follows: ten intervals between the concavity and the protrusion are measured at the any six places to determine the average value, and the average value of the average values of the six places is calculated. In the measurement, a cut-off value is 0.8 mm, and an evaluation length is 8 mm.

According to the present invention, the surface roughness (Rzjis, Rsm) of the charging member having the protrusion derived from the resin particle in the surface thereof is mainly adjusted according to the particle diameter of the resin particle as the raw material, the viscosity of the coating solution for forming a surface layer, the content of the resin particle in the coating solution for forming a surface layer, and the thickness of the surface layer. For example, an increase in the particle diameter of the resin particle as the raw material leads to an increased in Rzjis. An increase in the specific gravity or viscosity of the coating solution for forming a surface layer leads to a decrease in Rzjis. An increase in the thickness of the surface layer also leads to a decrease in Rzjis. Furthermore, an increase in the content of the resin particle as the raw material in the coating solution for forming a surface layer leads to a decrease in Rsm. Based on these, the factors above can be properly adjusted to obtain a charging member having a desired surface roughness.

When the surface layer is formed using the raw material resin particle that is the resin particle having a core-shell structure and the pore penetrating through the surface in the core portion and the shell portion and when a thickness of the surface layer is 10 times as long as the volume average particle diameter of the resin particle, the protrusion derived from the resin particle can be formed on the surface of the surface layer.

Namely, when a solid resin particle is used as the resin particle for forming the protrusion and the surface layer has a thickness 10 times as long as the volume average particle diameter of the resin particle, the resin particle is buried and difficult to form the protrusion derived from the resin particle on the surface of the surface layer.

However, when the resin particle having a core-shell structure and the pore penetrating through the surface in the core portion and the shell portion is used for the raw material resin particle, the protrusion derived from the core-shell type resin particle can be easily formed on the surface of the surface layer to be obtained. Although the reason is not clear, the present inventors presume that the resin particle moves to the coating surface side in the process in which the binder resin or binder resin raw material and the electro-conductive fine particle in the coating solution for forming a surface layer invade into the pores of the core-shell type resin particle.

Moreover, the surface layer may be surface treated. Examples of the surface treatment can include surface finishing using UV or an electron beam and surface modification by applying a compound to the surface and/or impregnating the surface with a compound.

When the film thickness is thick, namely, the coating solution has a small amount of the solvent, the solvent volatilizing rate may reduce, causing difficulties in control of formation of the electro-conductive domain. Accordingly, the concentration of the solid content in the coating solution can be relatively small. The solvent in the coating solution is preferably 40% by mass or more, more preferably 50% by mass or more, and particularly preferably 60% by mass or more.

The specific gravity of the coating solution is preferably 0.80 to 1.20 g/cm$^3$, and more preferably 0.85 to 1.00 g/cm$^3$. At a specific gravity within this range, the binder resin and the electro-conductive fine particle easily permeate into the pores of the porous resin particle.

[Volume Resistivity of Electro-Conductive Surface Layer]

The volume resistivity of the electro-conductive surface layer according to the present invention can be $1.0\times10^3$ to $1.0\times10^{13}$ Ω·cm in a 23° C./50% RH environment. At a volume resistivity within this range, it is easier to charge the electrophotographic photosensitive member properly by discharging.

The volume resistivity of the electro-conductive surface layer can be determined as follows. First, the electro-conductive surface layer is cut out from the charging member into a rectangular shape having a length of 5 mm×width of 5 mm. A metal is deposited onto both surfaces of the cut-out electro-conductive surface layer to obtain a sample for measurement. When the electro-conductive surface layer is too thin to cut out, a coating solution for an electro-conductive surface layer is applied onto an aluminum sheet to form a coat, a metal is deposited onto the surface of the coat on the same conditions as those for forming the electro-conductive surface layer to obtain a sample for measurement. A voltage of 200 V is applied to the sample for measurement using a microammeter (trade name: ADVANTEST R8340A ULTRA HIGH RESISTANCE METER, made by Advantest Corporation). Then, the current after 30 seconds is measured, and the volume resistivity is calculated from the film thickness and the electrode area and determined. The volume resistivity of the electro-conductive surface layer can be adjusted by the electro-conductive fine particle above.

Moreover, for control of the volume resistivity of the surface layer, the electro-conductive fine particle has a volume average particle diameter of preferably 10 to 900 nm, and more preferably 10 to 500 nm. At a volume average particle diameter within this range, the volume resistivity of the surface layer is easily controlled.

[Electro-Conductive Substrate]

The electro-conductive substrate has conductivity, and has a function to support the elastic layer or the like provided thereon. Examples of the material can include metals such as iron, copper, stainless steel, aluminum, and nickel and alloys thereof. Moreover, to give scratch resistance, the surfaces thereof may be plated or the like in the range in which conductivity is not impaired. Furthermore, for the electro-conductive substrate, substrates formed of resin base materials whose surfaces are covered with a metal to give conductivity to the surfaces or a conductivity resin composition can also be used.

[Electro-Conductive Elastic Layer]

In the charging member according to the present invention, an electro-conductive elastic layer may be formed between the electro-conductive substrate and the electro-conductive surface layer. The electro-conductive elastic layer does not need to be only one layer, and may have a layered structure including two or more layers. Known rubber can be used as rubber as the binder used for the electro-conductive elastic layer. Examples of the rubber can include resin, natural rubber, vulcanized natural rubber, and synthetic rubber.

For the resin, thermosetting resins and thermoplastic resins can be used, for example. Among these, fluorinated resin, polyamide resin, acrylic resin, polyurethane resin, silicone resin, butyral resin, and the like are more preferable.

For the synthetic rubber, the followings can be used: for example, ethylene propylene diene rubber (EPDM), styrene butadiene rubber (SBR), silicone rubber, urethane rubber, isoprene rubber (IR), butyl rubber, acrylonitrile butadiene rubber (NBR), chloroprene rubber (CR), acrylic rubber, and epichlorohydrin rubber. Moreover, thermoplastic elastomers such a styrene butadiene styrene block copolymers (SBS) and styrene ethylene butylene styrene block copolymers (SEBS) can also be used. These may be used alone or in combination of two or more.

Among these, polar rubber is more preferably used for easy control of resistance. Among these, epichlorohydrin rubber and NBR are preferable. These are advantageous in easy control of the resistance and hardness of the electro-conductive elastic layer.

The volume resistivity of the electro-conductive elastic layer measured under the 23° C./50% RH environment can be $1.0\times10^2$ Ω·cm or more and $1.0\times10^{10}$ Ω·cm or less.

The volume resistivity of the electro-conductive elastic layer can be determined in the same manner as in the case of the electro-conductive surface layer. Namely, the electro-conductive elastic layer is cut out from the charging member into a rectangular shape having a length of 5 mm×width of 5 mm. A metal is deposited onto both surfaces of the cut-out electro-conductive elastic layer to produce an electrode and a guard electrode. A voltage of 200 V is applied to the thus-obtained sample for measurement, and the current after seconds is measured using a microammeter. Then, the volume resistivity of the electro-conductive elastic layer is calculated from the thickness of the sample and the electrode area.

To adjust the volume resistivity, a known conductive agent can be properly added to the electro-conductive elastic layer. For the conductive agent, ionic conductive agents and electron conductive agents can be used. Furthermore, to adjust hardness and the like, additives such as softening oil and a plasticizer may be added to the electro-conductive elastic layer, or materials for giving various functions may be properly contained. Examples of these can include foaming agents, antioxidants, and fillers.

(Molding of Electro-Conductive Elastic Layer)

The method of molding the electro-conductive elastic layer is not particularly limited, and a known method may be properly used.

Specifically, for example, a composition including a variety of rubber components described above and other components is mixed with a ribbon blender, a Nauta Mixer, a Henschel mixer, a SUPERMIXER, a Banbury mixer, or a pressure kneader to obtain an unvulcanized rubber composition for an electro-conductive elastic layer.

Using an extruder including a crosshead, the electro-conductive substrate and the unvulcanized rubber composition prepared above are integrally extruded to produce an unvulcanized rubber roller. The crosshead is an extrusion metal mold used for covering of electric wires and wires. In use, the crosshead is mounted on the tip of the cylinder in the extruder.

Next, the unvulcanized rubber roller is vulcanized with a hot air furnace or the like. Subsequently, the roller surface is polished to adjust the shape of the roller.

The electro-conductive substrate may be bonded with an adhesive to the layer disposed immediately above the electro-conductive substrate. In this case, the adhesive preferably has conductivity. To give conductivity, the adhesive can contain a known conductive agent.

Examples of bonding resins of adhesive include thermosetting resins and thermoplastic resins. Known bonding resins such as urethane resin, acrylic resin, polyester resin, polyether resin, and epoxy resin can be used. Moreover, for the conductive agent for giving conductivity to the adhesive, ionic conductive agents can also be used in addition to the electro-conductive fine particle, and other electron conductive agents can also be used. These conductive agents can be used alone or in combination of two or more.

Moreover, when the electro-conductive elastic layer is included, the electro-conductive elastic layer may be bonded to the electro-conductive surface layer with the adhesive. When several electro-conductive elastic layers are included, the electro-conductive elastic layers may be bonded with the adhesive. The adhesive preferably has conductivity.

When the charging member according to the present invention is a charging roller for the electrophotographic apparatus, to charge the electrophotographic photosensitive member well, the electric resistance measured by the following method can be $1.0\times10^{3}$ to $1.0\times10^{10}\Omega$ in the 23° C./50% RH environment.

<Method of Measuring Electric Resistance of Charging Roller>

Figure 7:
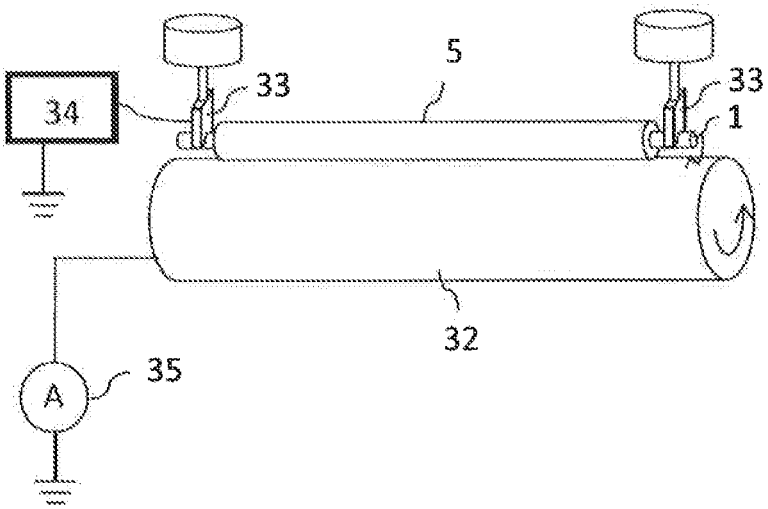
FIG. 7 is a diagram for describing a method of measuring an electric resistance value of a roller-shaped charging member.

FIG. 7 is a diagram illustrating one example of the method of measuring the electric resistance of the charging roller. A charging roller 5 is brought into parallel contact with a cylindrical metal 32 having the same curvature as that of the electrophotographic photosensitive member by applying loads to both ends of a electro-conductive substrate 1 with bearings 33 and 33. In this state, while the cylindrical metal 32 is rotated by a motor (not illustrated) and the charging roller 5 contacting is rotated following the rotation of the cylindrical metal 32, a DC voltage of −200 V is applied to the charging roller 5 from a stabilized power supply 34. The current flowing at this time is measured with an ammeter 35, and the resistance of the charging roller is calculated. In the present invention, each of the loads is 4.9 N, the diameter of the cylindrical metal is ϕ30 mm, and the circumferential speed of the cylindrical metal is 45 mm/sec.

<Crown Shape of Charging Roller>

In the present invention, from the viewpoint of a uniform nip width in the longitudinal direction with respect to the electrophotographic photosensitive member, the charging roller preferably has a crown shape in which the central portion in the longitudinal direction of the charging member is the thickest and the thickness of the charging roller reduces toward the ends in the longitudinal direction. The crown amount depends on the diameter of the charging roller, and the difference between the outer diameter of the central portion and the outer diameter of a position 90 mm spaced from the central portion can be 30 μm or more and 200 μm or less. The crown shape can be formed at the same time when the electro-conductive elastic layer is polished.

<Surface Hardness of Charging Member>

The surface hardness of the charging member is preferably 90° or less, and more preferably 40 to 80° measured with a microdurometer (MD-1 type). At a hardness within this range, the contact state of the charging member and the electrophotographic photosensitive member is easily stabilized, and discharge within the nip can be more stably performed. The "microhardness (MD-1 Type)" is a hardness of the charging member measured using an ASKER rubber microdurometer MD-1 Type (trade name, made by Kobunshi Keiki Co., Ltd.). Specifically, the hardness is a value when the charging member left in an environment of normal temperature and normal humidity (temperature: 23° C., relative humidity: 55%) for 12 hours or more is measured with the microdurometer in a peak hold mode at 10 N.

<Electrophotographic Apparatus>

Figure 8:
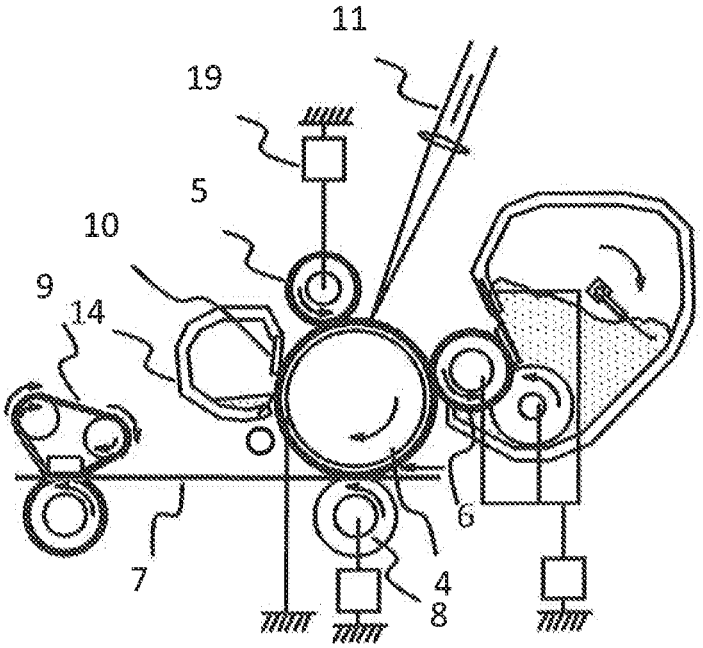
FIG. 8 is a schematic cross sectional view illustrating an embodiment of an electrophotographic apparatus according to the present invention.

One example of the schematic configuration of the electrophotographic apparatus having the charging member according to the present invention is illustrated in FIG. 8.

The electrophotographic apparatus includes the apparatuses below: an electrophotographic photosensitive member 4, a charging apparatus that charges the electrophotographic photosensitive member, a latent image forming apparatus 11 that forms a latent image by exposure, a developing apparatus that develops the latent image into a toner image, a transfer apparatus that transfers the toner image onto a transfer material, a cleaning apparatus that removes and recovers the transfer remaining toner on the electrophotographic photosensitive member, and a fixing apparatus 9 that fixes the toner image onto the transfer material.

In the electrophotographic apparatus illustrated in FIG. 8, the electrophotographic photosensitive member 4 is a rotary drum having the photosensitive layer on the electro-conductive substrate. The electrophotographic photosensitive member 4 is rotatably derived in the arrow direction at a predetermined circumferential speed (process speed).

The charging apparatus has a contact type charging roller 5 which is brought into contact with the electrophotographic photosensitive member 4 at a predetermined pressure to be contact disposed. The charging roller 5 rotates following the rotation of the electrophotographic photosensitive member 4. A predetermined DC voltage is applied from a power supply for charging 19 to charge the electrophotographic photosensitive member 4 to a predetermined potential. The charging member according to the present invention is used as this charging roller.

For the electrostatic latent image forming apparatus 11 that forms a latent image on the electrophotographic photosensitive member 4, an exposure apparatus such as a laser beam scanner is used, for example. The uniformly charged electrophotographic photosensitive member 4 is exposed corresponding to the image information to form an electrostatic latent image.

The developing apparatus includes a developing sleeve or developing roller 6 disposed close to or in contact with the electrophotographic photosensitive member 4. Using an electrostatically treated toner to have the same polarity as the charging polarity of the electrophotographic photosensitive member, an electrostatic latent image is developed by reversal development to form a toner image.

The transfer apparatus includes a contact type transfer roller 8, and transfers the toner image from the electrophotographic photosensitive member onto a transfer material 7 such as normal paper (transfer material is conveyed by a sheet feeding system having a conveying member).

The cleaning apparatus includes a blade type cleaning member 10 and a recovering container 14. After the toner image is transferred, the cleaning apparatus mechanically scrapes off the transfer remaining toner left on the electrophotographic photosensitive member 4 and recovers the toner. Here, the cleaning apparatus can be eliminated by adopting a simultaneous developing and cleaning method in which the transfer remaining toner is recovered with the developing apparatus.

The fixing apparatus 9 is composed of a heated roller or the like, and fixed the transferred toner image onto the transfer material 7. Subsequently, the fixing apparatus 9 discharges the transfer material having the fixed toner image to the outside of the apparatus.

<Process Cartridge>

In the electrophotographic apparatus, the electrophotographic photosensitive member and at least one of the charging apparatus, the developing apparatus, and the cleaning apparatus can be integrated into a process cartridge. For example, the process cartridge illustrated in FIG. 9 includes the electrophotographic photosensitive member 4, and the charging roller 5 disposed in contact with the electrophotographic photosensitive member 4. Moreover, the process cartridge further includes the developing apparatus including the developing sleeve 6 and the cleaning apparatus including the cleaning blade 10 and the recovering container 14. The process cartridge has a structure detachably mountable to the main body of the electrophotographic apparatus.

EXAMPLES

Hereinafter, the present invention will be described more in details using Examples.

First, before Examples, methods of measuring a variety of parameters in the present invention, Production Examples A1 to A26 of the resin particle, and Production Examples B1 and B2 of the electro-conductive fine particle and insulation particle will be described. In the particles below, the "average particle diameter" means the "volume average particle diameter" unless otherwise specified.

1. Methods of Measuring a Variety of Parameters

[1] Resin Particle as Raw Material Used in Formation of the Surface Layer (Porous Resin Particle and Other Resin Particles).

[1-1. Measurement of Stereoscopic Shape of Resin Particle as Raw Material]

The resin particle as the raw material (primary particle) is cut by 20 nm with a focused ion beam machining observation apparatus (trade name: FB-200C, made by Hitachi, Ltd.), and the image of the cross section is photographed. In the same resin particle, all the photographed cross sectional images are combined to determine the "stereoscopic shape" of the resin particle to be measured. This operation is performed on 100 resin particles. In the image of the cross section, the resin portion is taken in gray and the air portion is taken in white. Accordingly, the resin portion can be distinguished from the pore portion.

[1-2. Volume Average Particle Diameter]

From the stereoscopic shape of the resin particle obtained in [1-1], the total volume including the region including the pore portion is calculated, and the diameter of a sphere having a volume equal to the volume (hereinafter also referred to as an "equal volume diameter") is determined. This operation is performed on the 100 resin particle whose stereoscopic shapes are determined, and the equal volume diameters of the 100 resin particles in total are determined in the same manner as above. The arithmetic average value is defined as the volume average particle diameter of the resin particle as the raw material.

[1-3. Average Porosity of Porous Resin Particle]

First, the porous resin particle is embedded using a photocurable resin such as visible light-curable embedding resins (trade name: D-800, made by Nisshin EM Corporation, trade name: Epok812 Set, made by Okenshoji Co., Ltd). Next, after trimming is performed using a diamond knife "DiATOME CRYO DRY" (trade name, made by Diatome AG), the center of the porous resin particle (to include a portion in the vicinity of the center of gravity 301 illustrated in FIG. 6) is cut out to form a section having a thickness of 60 nm. The cut-out is performed by mounting the diamond knife on an ultramicrotome "LEICA EM UCT" (trade name, made by Leica) or a cryosystem "LEICA EM FCS" (trade name, made by Leica).

Subsequently, the embedding resin is dyed with any one of dyeing agent selected from osmium tetroxide, ruthenium tetraoxide, and phosphorus tungstate, and the cross sectional images of the 100 porous resin particles are photographed with a transmission electron microscope "H-7100 FA" (trade name, made by Hitachi, Ltd.). At this time, the resin portion is observed in white, and the pore portion is observed in black. A combination of the embedding resin and the dyeing agent is properly selected according to the material for the porous resin particle to clearly see the pore of the porous resin particle. For example, the pore in the porous resin particle A1 produced in Production Example A1 below could be clearly seen by using the "visible light-curable embedding resin D-800" (trade name) and ruthenium tetraoxide.

The cross sectional image of the particle obtained is defined as illustrated in FIG. 6.

In FIG. 6, a center of gravity 301 is defined as center of gravity when the area of the region including the pore portion in the porous resin particle is calculated, and it is assumed that the porous resin particle is a solid particle. A circle 302 is defined as a circle having the center of gravity 301 as the center of the circle and having an area equal to that of the region. Next, a circle 303 is defined as a circle having the center of gravity 301 as the center of the circle and having ½ of the diameter of the circle 302, and an inner side of the circle 303 is defined as an inner region 304. In the cross sectional image, the proportion of the total area of the pore portion in the inner region to the total area of the region including the pore portion in the inner region 304 is calculated. This is defined as a central portion porosity.

Next, concentric circles having a radius 100 nm larger than that of the circle 303 are sequentially formed toward the outer side of the inner region. The radius of one of the circles is defined as a radius 305, and the radius of an outer circle next to the circle having the radius 305 is defined as a radius 306. A region surrounded by the radius 305 and the radius 306 is defined as an outer shell region 307. In the cross sectional image, the proportion of the total area of the pore portion in the outer shell region to the total area of the region including the pore portion in the outer shell region 307 is defined as an outer shell region porosity.

The outer shell region porosity is sequentially calculated for every circle in which the radius of the circle increases in increments of 100 nm toward the outer side of the circle 303. When the outer shell region porosity reaches 1.2 times or more as much as the central portion porosity for the first time, the inner side of the radius 305 is defined as the core portion, and the outer side thereof is defined as the shell portion.

In the core portion and the shell portion, the proportion of the total area of the pore portion to the total area of the region including the pore portion is calculated. This operation is performed on any 10 porous resin particles. For the 10 particles, the porosities in the core portion and the porosities in the shell portion are averaged, respectively, to determine the average porosity in the core portion of the porous resin particle and that in the shell portion thereof.

Here, what to be measured actually is based on the area. However, it is determined that this is treated substantially as the volume without problem because observation is performed on a plurality of samples that are thin sections having a thickness nearly equal to the pore diameter.

[1-4. Average Pore Diameter in Core Portion of Porous Resin Particle and Average Pore Diameter in Shell Portion Thereof]

Any 10 pore portions observed in black in the core portion and shell portion determined in [1-3] are selected, respectively. The diameter of a circle having an area equal to the pore portion therein (equal area diameter) is determined, and defined as the diameter of the pore portion. The diameters of the pore portions in the core portion and those in the shell portion are averaged, respectively, and defined as the average pore diameter in the core portion of porous resin particle and the average pore diameter in the shell portion thereof. The measurement of the average pore diameter is performed on any 10 porous resin particles, and the obtained average pore diameters are averaged again. The averaged values are defined as the average pore diameter in the core portion of the porous resin particle and that in the shell portion thereof, respectively.

[1-5] Average Porosities of Other Resin Particles

From the stereoscopic shape of the resin particle obtained in [1-1], the total volume of the region including air is calculated, and the proportion thereof to the total volume of the resin particle including the region including air is calculated. The proportion is calculated in 100 resin particles as the raw material, and the arithmetic average value is defined as the "average porosity" of other resin particles.

[1-6] Average Pore Diameter of Other Resin Particles

From the stereoscopic shape of the resin particle obtained in [1-1], the volume of any 10 pores not penetrating through the surface of the resin particle (non-through holes) is determined when 11 or more non-through holes exist, and the volume of all the non-through holes is determined when 10 or less non-through holes exist. The diameter of a sphere having a volume equal to the volume is determined. This operation is performed on 10 resin particles. The arithmetic average value of the volumes of the obtained 100 spheres is determined, and defined as the "average pore diameter" of the other resin particles.

[2] Resin Particle Included in Surface Layer

[2-1. Stereoscopic Image of Stereoscopic Particle Shape of Resin Particle Included in Surface Layer]

In any protrusion on the surface of the charging member, the entire region having a length of 200 μm and a width of 200 μm and being parallel to the charging member surface is cut out by 20 nm from a vertex side of protrusion of the charging member with a focused ion beam machining observation apparatus (trade name: FB-2000C, made by Hitachi, Ltd.), and the cross sectional image is photographed. The images obtained by photographing the same protrusion are combined at an interval of 20 nm to form a stereoscopic image of the resin particle that forms the protrusion. This operation is performed on any 100 protrusions on the surface of the charging member to obtain the stereoscopic images of the 100 resin particles that form the protrusions.

[2-2. Volume Average Particle Diameter of Resin Particle Included in Surface Layer]

In the stereoscopic image of the resin particle obtained by the method described in [2-1], the total volume including the electro-conductive domain in the resin particle is calculated. This is the volume of the resin particle assuming that the resin particle is a solid particle. The diameter of a sphere having a volume equal to the volume (equal volume diameter) is determined, and defined as the volume particle diameter of the resin particle. By the method, the particle diameters of the 100 resin particles obtained in [2-1] are determined, and the arithmetic average value is defined as the volume average particle diameter of the resin particle included in the surface layer.

[2-3. Cross Sectional Image of Resin Particle Included in Surface Layer]

A section having a width of 5 mm×length of 5 mm is cut out from the surface of the charging member to include the protrusion derived from the resin particle, and the section is embedded using the embedding resin "Epok812 Set" (trade name). The embedded section is cut using an ultramicrotome (trade name: LEICA EM UCT; made by Leica and cryosystem (trade name: LEICA EM FCS; made by Leica) on which a diamond knife (trade name: DiATOME CRYODRY, made by Diatome AG) is mounted, such that the center of gravity of the resin particle that forms the protrusion or the vicinity thereof is include. Thus, a section having a thickness of 100 nm is produced. The section is dyed with osmium tetroxide, ruthenium tetraoxide, or phosphorus tungstate. Next, the dyed section is photographed using a transmission electron microscope "H-7100FA" (trade name). In the photographed image, the resin portion of the resin particle is observed in white, and the electro-conductive domain (portion in which the electro-conductive fine particle aggregates) is observed in black. This operation is performed on any 100 protrusions.

[2-4. Electro-Conductive Domain Region Width of Resin Particle Included in Surface Layer]

From the cross section of the resin particle illustrated in the cross sectional image obtained by the method described in [2-3], the area of the cross section of the resin particle is determined, the radius (hereinafter also referred to as an "equal area radius") of a circle having an area equal to the area of the cross section (hereinafter also referred to as a "first circle") and the center of gravity are determined. Next, the largest circle having the center of gravity in the cross section of the resin particle as the center and including no image of the electro-conductive domain (hereinafter also referred to as a "second circle") is defined, and the radius of the second circle is defined as the radius of a non-conductive portion of the resin particle. A region surrounded by the surface of the resin particle and the second circle in the cross section of the resin particle is defined as an electro-conductive domain region. Moreover, the value of the width of the electro-conductive domain region is determined by subtracting the radius of the second circle from the radius of the first circle. The values of the widths of the electro-conductive domain regions obtained for the 100 protrusion cross sectional images are determined, and the arithmetic average value is defined as the value of the electro-conductive domain region width of the resin particle included in the surface layer in the charging member.

[2-5. Proportion of Electro-Conductive Domain Included in Electro-Conductive Domain Region]

In the cross section of the resin particle defined in [2-4], the total area of the image of the electro-conductive domain in the resin particle is determined, and the proportion thereof to the area of the electro-conductive domain region in the resin particle is calculated. The proportions of the cross sectional images of the 100 protrusions are averaged, and defined as the proportion of the electro-conductive domain included in the electro-conductive domain region included in the resin particle included in the surface layer in the charging member.

[2-6. Diameter of Electro-Conductive Domain of Resin Particle Included in Surface Layer]

The diameter of a circle having an area equal to the image of the electro-conductive domain used for calculation of the total area of the electro-conductive domain in [2-5] is determined, and defined as the diameter of the electro-conductive domain. The arithmetic average value is defined as the diameter of the electro-conductive domain in the resin particle. The arithmetic average value of the diameters of the electro-conductive domains of the cross sectional images of the 100 protrusions is defined as the diameter of the electro-conductive domain of the resin particle included in the surface layer in the charging member.

2. Production Examples of Porous Resin Particle

Production Example A1

Production of Resin Particle A1

8.0 parts by mass of tricalcium phosphate was added to 400 parts by mass of deionized water to prepare an aqueous medium. 32.0 parts by mass of methyl methacrylate, 21.9 parts by mass of ethylene glycol dimethacrylate, 23.6 parts by mass of normal hexane, 12 parts by mass of ethyl acetate, and 0.3 parts by mass of 2,2'-azobisisobutyronitrile were mixed to prepare an oily mixed solution. The oily mixed solution was dispersed in the aqueous medium with a homomixer at the number of rotation of 3600 rpm. Subsequently, a polymerization reaction container was replaced with nitrogen, and the solution was charged into the container. While the solution was being stirred at 250 rpm, the solution was suspension polymerized at 60° C. over 6 hours to obtain an aqueous suspension of the porous resin particle including normal hexane and ethyl acetate.

0.4 parts by mass of sodium dodecylbenzenesulfonate was added to the obtained aqueous suspension, and the suspension was adjusted to contain 0.1% by mass of sodium dodecylbenzenesulfonate based on water. Next, the aqueous suspension was distilled to remove normal hexane and ethyl acetate. After removal, the aqueous suspension was filtered, and the obtained resin particle was repeatedly washed with water. Then, the resin particle was dried at 80° C. for 5 hours. Subsequently, the dried resin particle was crushed and classified with a sonic classifier to obtain a porous resin particle A1 having an average particle diameter of 18.5 μm. The cross section of the particle was observed by the method described above. The porous resin particle A1 had a pore of 23 nm in the core portion and a pore of 98 nm in the shell portion.

Production Examples A2 to A23

Production of Porous Resin Particles A2 to A23

Porous resin particles A2 to A23 were obtained in the same manner as in Production Example A1 except that the kinds and amounts of the polymerizable monomer, the crosslinkable monomer, the first porosifying agent, and the second porosifying agent to be used and the number of rotation of the homomixer were changed as shown in Table 1.

Production Example A24

Production of Solid Resin Particle A24

A commercially available crosslinkable polymethyl methacrylate resin particle (trade name: MBX-30, made by SEKISUI PLASTICS CO., Ltd.) was used as it was for the solid resin particle A24. The resin particle had no pore inside thereof.

Production Example A25

Production of Multi-Hollow Resin Particle A25

10.5 parts by mass of tricalcium phosphate and 0.015 parts by mass of sodium dodecylbenzenesulfonate were added to 300 parts by mass of deionized water to prepare an aqueous medium. 65 parts by mass of lauryl methacrylate, 30 parts by mass of ethylene glycol dimethacrylate, 0.04 parts by mass of poly(ethylene glycol-tetramethylene glycol)monomethacrylate, and 0.5 parts by mass of azobisisobutyronitrile were mixed to prepare an oily mixed solution. The oily mixed solution was dispersed in the aqueous medium with a homomixer at the number of rotation of 3600 rpm. A polymerization reaction container was replaced with nitrogen, and the solution was charged into the container. While the solution was being stirred at 250 rpm, the solution was suspension polymerized at 70° C. over 8 hours. After cooling, hydrochloric acid was added to the obtained suspension to decompose calcium phosphate. After calcium phosphate was decomposed, the suspension was filtered, and the obtained resin particle was repeatedly washed with water. Then, the resin particle was dried at 80° C. for 5 hours. Subsequently, the dried resin particle was crushed and classified with a sonic classifier to obtain a multi-hollow resin particle A25 having a volume average particle diameter of 20.2 μm. The cross section of the particle was observed by the method described above. The multi-hollow resin particle A24 had a pore of approximately 300 nm inside thereof.

Production Example A26

Production of Single-Hollow Resin Particle A26

20 parts by mass of tricalcium phosphate and 0.04 parts by mass of sodium dodecylbenzenesulfonate were added to 300 parts by mass of deionized water to prepare an aqueous medium. 10 parts by mass of methyl acrylate, 81 parts by mass of styrene, 9 parts by mass of divinylbenzene, 0.8 parts by mass of azobisisobutyronitrile, and 1 part by mass of a surfactant (trade name: Solsperse 26000, made by Lubrizol Corporation) were mixed to prepare an oily mixed solution. The oily mixed solution was dispersed in the aqueous medium with a homomixer at the number of rotation of 3800 rpm, and a single-hollow resin particle A26 having a volume average particle diameter of 15.2 μm was obtained in the same manner as in Production Example A25. The cross section of the particle was observed by the method described above. The single-hollow resin particle A26 was a single-hollow particle having one hollow portion inside thereof.

The cross sectional image of the single-hollow particle was photographed using the method described in [1-1]. The hollow portion does not penetrate through the surface of the particle, and the embedding resin cannot invade into the hollow portion. Accordingly, the hollow portion was observed as a gray portion in the cross sectional image. The diameter of a circle having an area equal to that of the hollow portion observed as a gray portion was determined, and defined as the diameter of the hollow portion. For 100 single-hollow resin particles A26 in total, the diameters were determined in the same manner as above, and the volume average particle diameter thereof was determined. The value was determined as the volume average particle diameter of the hollow portion in the single-hollow particle A26. As a result, the volume average particle diameter of the hollow portion in the single-hollow resin particle A26 was 4.2 μm.

[Evaluation of Properties of Resin Particles]

For the particles A1 to A26, the volume average particle diameter, the electro-conductive domain region width, the average porosity in the core portion, the average porosity in the shell portion, and the average pore diameter were measured by the methods described above. The results are shown in Table 2. The shape of the particle (porous, solid, multi-hollow, or single-hollow) is also shown in Table 2.

Production Example B-1

Production of Composite Electro-Conductive Fine Particle 140 g of methylhydrogen polysiloxane was added to 7.0 kg of a silica particle (volume average particle diameter: 40 nm, volume resistivity: $1.8\times10^{12}$ Ω·cm) while an edge runner was being operated. The materials were mixed and stirred for 30 minutes at a line load of 588 N/cm (60 kg/cm). At this time, the stirring rate was 22 rpm.

To the mixture, 7.0 kg of a carbon black particle (volume average particle diameter: 20 nm, volume resistivity: $1.0\times10^{2}$ Ω·cm, pH: 8.0) was added over 10 minutes while an edge runner was being operated. The materials were further mixed and stirred for 60 minutes at a line load of 588 N/cm (60 kg/cm). Thus, carbon black was applied to the surface of the methylhydrogen polysiloxane-covered silica particle. Then, the particle was dried using a dryer at 80° C. for 60 minutes to obtain a composite electro-conductive fine particle. At this time, the stirring rate was 22 rpm. The obtained composite electro-conductive fine particle had a volume average particle diameter of 50 nm and a volume resistivity of $1.1\times10^{2}$ Ω·cm.

Production Example B-2

Preparation of Surface Treated Titanium Oxide Particle 110 g of isobutyltrimethoxysilane as a surface treatment agent and 3000 g of toluene as a solvent were blended with 1000 g of a needle-like rutil titanium oxide particle (average particle diameter: 15 nm, length:width=3:1, volume resistivity $2.3\times10^{10}$ Ω·cm) to prepare a slurry. After the slurry was mixed with a stirrer for 30 minutes, the slurry was fed to a Visco Mill having glass beads having an average particle diameter of 0.8 mm filled into 80% of the effective inner volume. Then, the slurry was wet crushed at a temperature 35±5° C. Using a kneader, toluene was removed from the slurry by the wet crushing by reduced pressure distillation (bath temperature: 110° C., product temperature: 30 to 60° C., reduced pressure degree: approximately 100 Torr). Then, a surface treatment agent was baked to the slurry at 120° C. for 2 hours. The baked particle was cooled to room temperature, and ground using a pin mill to produce a surface treated titanium oxide particle. The obtained surface treated titanium oxide particle had a primary particle having a volume average particle diameter of 15 nm and a volume resistivity of $5.2\times10^{15}$ Ω·cm.

[Preparation of Elastic Roller]

The materials used to form the charging member are:

Electro-Conductive Substrate

A thermosetting adhesive containing 10% by mass of carbon black was applied to a stainless steel rod having a diameter of 6 mm and a length of 244 mm, and dried. This coated rod was used as the electro-conductive substrate.

Elastic Layer Raw Material epichlorohydrin rubber: EO-EP-AGC ternary compound (EO/EP/AGE=73 mol %/23 mol %/4 mol %).

NBR: acrylonitrile butadiene rubber "JSR N230SV" (trade name, made by JSR Corporation).

calcium carbonate: calcium carbonate "Silver W" (trade name, made by Shiraishi Kogyo Kaisha, Ltd.).

adipic acid ester: adipic acid ester plasticizer "POLYCIZER W305ELS" (trade name, made by DIC Corporation). zinc stearate: zinc stearate "SZ-2000" (trade name, made by Sakai Chemical Industry Co., Ltd.).

MB:2-mercapto benzimidazole (antioxidant).

zinc oxide: two zinc oxide (made by Sakai Chemical Industry Co., Ltd.).

quaternary ammonium salt LV: charge preventing plasticizer "ADEKA CIZER LV70" (trade name, made by ADEKA Corporation).

carbon black A: carbon black "Thermax flow formN990" (trade name, made by Cancarb Ltd., Canada, volume average particle diameter of the primary particle: 270 nm).

carbon black B: carbon black "TOKABLACK #7360SB" (trade name, made by Tokai Carbon Co., Ltd., arithmetic average particle diameter of the primary particle: 28 nm).

sulfur: sulfur (vulcanizing agent).

DM: dibenzothiazyl sulfide (vulcanization accelerator).

TS: tetramethylthiuram monosulfide (vulcanization accelerator).

TBzTD: tetrabenzylthiuram disulfide "Perka Cit TBzTD" (vulcanization accelerator) (trade name, available from TESCO COMPANY LIMITED).

Production Example 1

Preparation of Elastic Roller 1

[Preparation of Electro-Conductive Rubber Composition]

The components below were added to 100 parts by mass of the epichlorohydrin rubber, and kneaded for 10 minutes with a sealed type mixer adjusted to 50° C. to prepare a raw material compound.

| | |
|---|---|
| calcium carbonate | 80 parts by mass |
| adipic acid ester | 8 parts by mass |
| zinc stearate | 1 part by mass |
| antioxidant MB | 0.5 parts by mass |
| zinc oxide | 2 parts by mass |
| quaternary ammonium salt LV70 | 2 parts by mass |
| carbon black A | 5 parts by mass |

0.8 parts by mass of sulfur, 1 part by mass of the vulcanization accelerator DM, and 0.5 parts by mass of the vulcanization accelerator TS were added to the raw material compound, and the mixture was kneaded for 10 minutes with a two-roll mill cooled to 20° C. to prepare an electro-conductive rubber composition. At this time, the interval in the two-roll mill was adjusted to be 1.5 mm.

[Preparation of Elastic Roller]

Using an extrusion molding apparatus including a cross-head, the electro-conductive substrate was used as the center shaft, and coaxially covered with the prepared electro-conductive rubber composition above to obtain a roller having an unvulcanized elastic layer. The thickness of the covering electro-conductive rubber composition was 1.75 mm.

The obtained roller was heated at 160° C. for one hour in a hot air furnace, and ends of the elastic layer were removed such that the length was 224 mm. Furthermore, the roller was secondarily heated at 160° C. for one hour to prepare a roller having an electro-conductive rubber covering layer having a layer thickness of 1.75 mm.

The outer peripheral surface of the obtained roller was polished using a plunge cutting mode cylinder polishing to produce an elastic roller 1. A vitrified grinding wheel was used as the polishing grinding wheel. The abrasive grain was green silicon carbide (GC), and the grain size was 100 mesh. The number of rotation of the roller was 350 rpm, and the number of rotation of the polishing grinding wheel was 2050 rpm. The rotational direction of the roller was the same as the rotational direction of the polishing grinding wheel (following direction). The cutting speed was changed step-wise from 10 mm/min to 0.1 mm/min from a time when the grinding wheel was brought into contact with the unpolished roller to a time when the roller was polished to Φ9 mm. The spark-out time (time at a cutting amount of 0 mm) was set 5 seconds.

The thickness of the elastic layer was 1.5 mm. The crown amount of the roller (difference in the outer diameter between the central portion and a position 90 mm spaced from the central portion) was 100 μm.

Production Example 2

Preparation of Elastic Roller 2

An elastic roller 2 having an elastic layer thickness of 1.5 mm was prepared in the same manner as in Production Example 1 except that the electro-conductive rubber composition was changed to a composition prepared by the following preparation method using NBR as a base rubber.

[Preparation of Electro-Conductive Rubber Composition]

The components below were added to 100 parts by mass of NBR, and kneaded for 15 minutes with a sealed type mixer adjusted to 50° C. to prepare a raw material compound.

| | |
|---|---|
| carbon black B | 65 parts by mass |
| zinc stearate | 1 part by mass |
| zinc oxide | 5 parts by mass |
| calcium carbonate | 20 parts by mass |

1.2 parts by mass of sulfur and 4.5 parts by mass of the vulcanization accelerator TBzTD were added to the raw material compound, and kneaded for 10 minutes with a two-roll mill cooled to a temperature of 25° C. to prepare an electro-conductive rubber composition.

[Preparation of Charging Roller]

The elastic roller prepared above was used as the substrate, and an electro-conductive surface layer was formed on the surface of the substrate to prepare a charging roller. First, the raw materials used to form the surface layer are:

Binder Resin acrylic polyol solution A: caprolactone-modified acrylic polyol solution "Placcel DC2016" (trade name, made by Daicel Corporation) whose solid content was adjusted to be 17% by mass with methyl isobutyl ketone.

acrylic polyol solution B: caprolactone-modified acrylic polyol solution "Placcel DC2016" (trade name) whose solid content was adjusted to be 14% by mass with methyl isobutyl ketone.

block isocyanate mixture: 7:3 mixture in a molar ratio of butanone oxime block in hexamethylene diisocyanate (HDI) and that in isophorone diisocyanate (IPDI).

Conductive Agent composite electro-conductive fine particle: produced in Production Example B-1 above.

carbon black C: carbon black "Mitsubishi carbon black #52" (trade name, made by Mitsubishi Chemical Corporation, average particle diameter: 27 nm).

Resin Particle for Forming Protrusion porous resin particles A1 to A23: produced in Production Examples A1 to A23.

other resin particles A24 to 26: produced in Production Examples A24 to A26.

Other Components silicone oil: modified dimethylsilicone oil "SH28PA" (trade name, made by Dow Corning Toray Silicone Co., Ltd.).

surface treated titanium oxide particle: produced in Production Example B-2.

Example 1

1. Preparation of Coating Solution for Forming a Surface Layer

The components below were added to 588.24 parts by mass of an acrylic polyol solution A (acrylic polyol solid content: 100 parts by mass) to prepare a mixed solution.

| | |
|---|---|
| composite electro-conductive fine particle | 55 parts by mass |
| surface treated titanium oxide particle | 35 parts by mass |
| modified dimethylsilicone oil | 0.08 parts by mass |
| block isocyanate mixture | 80.14 parts by mass |

At this time, the block isocyanate mixture had an amount of isocyanate at "NCO/OH=1.0" to hydroxyl group contained in acrylic polyol.

200 g of the mixed solution was placed in a glass bottle having an inner volume of 450 mL, and 200 g of glass beads as a medium having an average particle diameter of 0.8 mm was added. Using a paint shaker dispersing machine, the mixed solution was dispersed for 24 hours. 8.96 g of the resin particle A1 was added to the dispersion solution (40 parts by mass of the porous resin particle based on 100 parts by mass of the acrylic polyol solid content). Subsequently, the solution was dispersed for 5 minutes, and the glass beads were removed to obtain a coating solution for forming a surface layer. The coating solution had a specific gravity of 0.9110 g/ml (25° C.). The specific gravity was measured by placing a commercially available densimeter in the coating solution.

2. Formation of Surface Layer

The elastic roller 1 prepared in Production Example 1 was directed in the longitudinal direction, vertically immersed in the coating solution, and coated by dipping. The immersion time was 9 seconds. As the take-up rate, the initial rate was 20 mm/s, and the final rate was 2 mm/s. In-between, the take-up rate was linearly changed with respect to time. The obtained coated product was air dried at 23° C. for 30 minutes, dried at a temperature of 100° C. for one hour with a hot air circulation dryer, and further dried at a temperature of 160° C. for one hour to cure the coat. Thus, a charging roller 1 was formed in which the elastic layer and the surface layer were formed in this order in the outer peripheral portion of the electro-conductive substrate. The thickness of the surface layer in the obtained charging roller 1 was measured. The thickness of the surface layer was measured in a portion wherein no resin particle existed.

3. Evaluation of Properties of Resin Particle Included in Surface Layer

By the methods above, for the resin particle included in the surface layer in the charging roller 1, the volume average particle diameter, the proportion of the electro-conductive domain, the diameter of the electro-conductive domain, and the electro-conductive domain region width were measured. Moreover, as an index indicating how much the electro-conductive domain particle was localized on the surface side of the resin particle, the proportion of the electro-conductive domain region width to the volume average particle diameter (in Tables 3 and 4, expressed a "Proportion of region width in particle diameter") was calculated. The results are shown in Table 3.

4. Measurement of Electric Resistance of Charging Roller

The electric resistance of the prepared charging roller 1 was measured by the method above. The measurement conditions were 23° C. and 50% RH. The results are shown in Table 3.

[Evaluation of Image]

Figure 9:
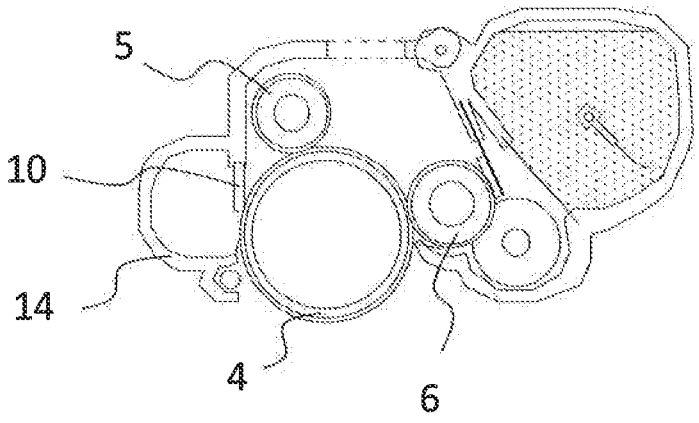
FIG. 9 is a schematic cross sectional view illustrating an embodiment of a process cartridge according to the present invention.

Using an electrophotographic apparatus having the configuration illustrated in FIG. 9, a monochrome laser printer "Satera LBP6300" (trade name, made by Canon Inc.), the performance of the charging roller was evaluated according to the evaluation of the electrophotographic image formed using the charging roller. Specifically, a peak to peak voltage (Vpp) of 1400 V, an AC voltage having a frequency (f) of 1350 Hz, and a DC voltage (Vdc) of −560 V were applied to the charging member in the printer from the outside. The resolution of the image to be output was 600 dpi. The process cartridge for the printer "Toner cartridge 519II) (trade name, made by Canon Inc.) was modified and used.

Moreover, as the toner, a toner extracted from the process cartridge "Toner cartridge 326" (trade name, made by Canon Inc.) for the monochrome laser printer "Satera LBP6200" (trade name, made by Canon Inc.) was used.

Figure 10:
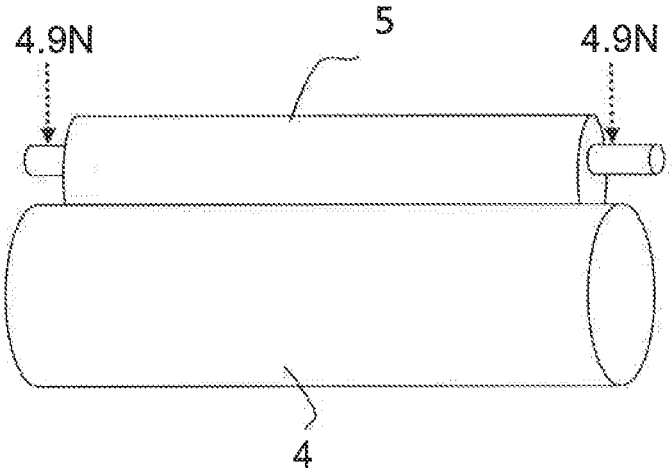
FIG. 10 is a schematic view for describing the contact state of the charging roller and the electrophotographic photosensitive member.

Furthermore, a charging roller in the process cartridge was dismounted, and the prepared charging roller was mounted in contact with the electrophotographic photosensitive member by springs at a pressure of 4.9 N at one end and 9.8 N in total at both ends as illustrated in FIG. 10. Thus, three process cartridges for evaluation were prepared.

The process cartridges for evaluation stood for 24 hours in a 7.5° C./30% RH environment (environment 1), a 15° C./10% RH environment (environment 2), and a temperature 23° C./humidity 50% RH environment (environment 3), respectively. An electrophotographic image was formed in the respective environments as follows.

The electrophotographic image was a horizontal line image at a width of 2 dots and an interval of 186 dots drawn in the direction perpendicular to the rotational direction of the electrophotographic photosensitive member. 10000 sheets of the image was output. The 10000 sheets were output on the conditions wherein the number of outputs was 2500 sheets per day, and the rotation of the printer was paused for 3 seconds every two outputs. After the 10000 sheets were output, one sheet of a halftone image was output. Subsequently, only the charging roller was extracted from the process cartridge used in formation of the image, another process cartridge was mounted, and the same image forming test was performed. In the respective charging rollers, the image forming test was performed three times in total, in which 30000 sheets in total were output and three sheets in total of the halftone image were output. The halftone image refers to an image in which a horizontal line at a width of one dot and an interval of two dots is drawn in the direction perpendicular to the rotational direction of the electrophotographic photosensitive member. In the evaluation of the image, the thus-obtained halftone images (hereinafter referred to as Image Nos. 1 to 3) were visually observed, and production of a moire image was determined based on Ranks below. The results of evaluation are shown in Table 5.

Rank 1: no moire image is produced.

Rank 2: a moire image is slightly found in part of the image.

Rank 3: a moire image can be found, but has no practical problem.

Rank 4: a moire image is produced in the entire image, and the quality of the image is reduced.

The moire image is a phenomenon that occurs by interfering uneven charging caused by the cycle of the AC voltage applied to the charging roller and the horizontal line in the halftone image. When the protrusion formed on the surface of the charging roller functions as the discharge point, dot-like charge by the discharge point cancels the uneven charging caused by the cycle of the applied voltage, therefore caused no interference with the dots in the halftone image. Namely, the reduced function of the discharge point in the step of forming the electrophotographic image may produce the moire image. The evaluation of the image can reveal the correlation between the effect of suppressing the reduction in the function of the protrusion derived from the resin particle as the discharge point and the quality of the electrophotographic image.

Examples 2 to 7

Charging rollers 2 to 7 were prepared in the same manner as in Example 1 except that the kind of the porous resin particle for forming the protrusion was changed as shown in Table 3, and evaluated in the same manner as in Example 1. The results of evaluation are shown in Tables 3 and 5.

Examples 8 to 14

A coating solution for forming a surface layer was prepared as follows.

[Preparation of Coating Solution for Forming Surface Layer]

The components below were added to 714 parts by mass of the acrylic polyol solution B (acrylic polyol solid content: 100 parts by mass) to prepare a mixed solution.

| | |
|---|---|
| carbon black C | 25 parts by mass |
| surface treated titanium oxide particle | 25 parts by mass |
| modified dimethylsilicone oil | 0.08 parts by mass |
| block isocyanate mixture (NCO/OH = 1.0) | 80.14 parts by mass |

187 g of the mixed solution was placed in a glass bottle having an inner volume of 450 mL, and 200 g of glass beads as a medium having an average particle diameter of 0.8 mm was added. Using a paint shaker dispersing machine, the mixed solution was dispersed for 48 hours. After dispersion, 8.25 g of the porous resin particle as shown in Table 3 was added (50 parts by mass of the porous resin particle based on 100 parts by mass of the acrylic polyol solid content). Subsequently, the solution was dispersed for 5 minutes and the glass beads were removed to prepare an electro-conductive coating solution for forming a surface layer. The specific gravity of the coating solution was 0.9000.

A charging roller was prepared in the same manner as in Example 1 except these, and evaluated. The results of evaluation are shown in Tables 3 and 5.

Examples 15 to 21

Charging rollers 15 to 21 were prepared in the same manner as in Example 1 except that the kind of the resin particle was changed as shown in Table 3, and evaluated in the same manner as in Example 1. The results of evaluation are shown in Tables 3 and 5.

Examples 22 to 24

Charging rollers 22 to 24 were prepared in the same manner as in Example 8 except that the elastic roller 2 prepared in Production Example 2 was used as the elastic roller and the coating solution for forming a surface layer prepared using the porous resin particle changed as shown in Table 3 was used, and evaluated in the same manner as in Example 8. The results of evaluation are shown in Tables 3 and 5.

Example 25

A charging roller 25 was prepared in the same manner as in Example 1 except that in the formation of the surface layer in Example 1, heating with the hot air circulation drying furnace at a temperature 100° C. for one hour was changed to that at 80° C. for one hour, and evaluated in the same manner as in Example 1. The results of evaluation are shown in Tables 3 and 5.

Comparative Examples 1 to 3

Charging rollers 26 to 28 were prepared in the same manner as in Example 1 except that the porous resin particle A1 was changed to the solid resin particle A24, the multi-hollow resin particle A25, or the single-hollow resin particle A26, and evaluated in the same manner as in Example 1. The results of evaluation are shown in Tables 4 and 6. These charging rollers had no electro-conductive domain in the protrusion of the resin particle in the surface layer.

TABLE 1

| Raw material | Polymerizable monomer | | Crosslinkable monomer | | Porosifying agent | | | | The number of rotation of |
|---|---|---|---|---|---|---|---|---|---|
| resin particle No. | Compound | (parts by mass) | Compound | (parts by mass) | Compound | (parts by mass) | Compound | (parts by mass) | homomixer (rpm) |
| A1 | MMA | 32.0 | EDMA | 21.9 | Hx | 23.6 | EAc | 12.0 | 3600 |
| A2 | St | 25.0 | EDMA | 17.1 | Hx | 26.6 | Ace | 7.5 | 2100 |
| A3 | BMA | 32.0 | EDMA | 21.9 | Hx | 30.0 | PAc | 3.0 | 2200 |
| A4 | BMA | 28.0 | EDMA | 19.2 | Hx | 23.6 | MAc | 9.5 | 3900 |
| A5 | St | 32.0 | EDMA | 21.9 | Hx | 33.3 | Ace | 3.0 | 700 |
| A6 | MMA + St | 14.0 14.0 | HDMA | 19.2 | Hx | 30.0 | MAc | 7.5 | 2300 |

TABLE 1-continued

| Raw material resin particle No. | Polymerizable monomer Compound | (parts by mass) | Crosslinkable monomer Compound | (parts by mass) | Porosifying agent Compound | (parts by mass) | Compound | (parts by mass) | The number of rotation of homomixer (rpm) |
|---|---|---|---|---|---|---|---|---|---|
| A7 | MMA | 28.0 | EDMA | 19.2 | Hx | 17.2 | MAc | 15.0 | 1600 |
| A8 | MMA + | 10.0 | EDMA | 17.1 | Hx | 33.3 | MAc | 7.5 | 2000 |
| | St | 15.0 | | | | | | | |
| A9 | BMA | 38.0 | EDMA | 26.0 | Hx | 17.2 | PAc | 4.5 | 3800 |
| A10 | BMA | 38.0 | EDMA | 26.0 | Hx | 23.6 | MAc | 7.5 | 3100 |
| A11 | MMA | 25.0 | EDMA | 17.1 | Hx | 33.3 | EAc | 15.0 | 3500 |
| A12 | BMA + | 16.0 | EDMA | 21.9 | Hx | 26.6 | EAc | 12.0 | 800 |
| | MMA | 16.0 | | | | | | | |
| A13 | BMA | 38.0 | EDMA | 26.0 | Hx | 23.6 | PAc | 4.5 | 1600 |
| A14 | MMA | 28.0 | HDMA | 19.2 | Hx | 33.3 | EAc | 3.5 | 1100 |
| A15 | St | 32.0 | EDMA | 21.9 | Hx | 23.6 | MAc | 4.5 | 2500 |
| A16 | St | 38.0 | HDMA | 26.0 | Hx | 17.2 | Ace | 7.5 | 3600 |
| A17 | MMA | 32.0 | EDMA | 21.9 | Hx | 26.6 | MAc | 4.5 | 1700 |
| A18 | MMA + | 14.0 | HDMA | 19.2 | Hx | 17.2 | Ace | 15.0 | 4000 |
| | St | 14.0 | | | | | | | |
| A19 | St | 28.0 | HDMA | 19.2 | Hx | 30.0 | Ace | 4.5 | 3000 |
| A20 | BMA + | 15.0 | EDMA | 17.1 | Hx | 26.6 | PAc | 12.0 | 1200 |
| | MMA | 10.0 | | | | | | | |
| A21 | BMA + | 14.0 | EDMA | 19.2 | Hx | 33.3 | EAc | 3.0 | 800 |
| | MMA | 14.0 | | | | | | | |
| A22 | MMA | 25.0 | EDMA | 17.1 | Hx | 30.0 | EAc | 4.5 | 1600 |
| A23 | MMA | 32.0 | EDMA | 21.9 | Hx | 26.6 | EAc | 3.0 | 1300 |

Note)
Compound in Table 1 means:
MNA: methyl methacrylate
BMA: n-butyl methacrylate
St: styrene
EDMA: ethylene glycol dimethacrylate
HDMA: 1,6-hexanediol dimethacrylate
Hx: normal hexane
EAc: ethyl acetate
MAc: methyl acetate
PAc: isopropyl acetate
Ace: acetone

TABLE 2

| Resin particle No. | Shape of particle | Volume average particle diameter (μm) | Shell portion thickness (μm) | Core portion pore Average pore diameter (nm) | Core portion pore Average porosity (%) | Shell portion pore Average pore diameter (nm) | Shell portion pore Average porosity (%) |
|---|---|---|---|---|---|---|---|
| A1 | Porous | 18.5 | 1.3 | 23 | 18 | 98 | 30 |
| A2 | Porous | 28.2 | 1.0 | 31 | 24 | 194 | 53 |
| A3 | Porous | 30.6 | 0.4 | 22 | 13 | 76 | 25 |
| A4 | Porous | 15.1 | 1.0 | 16 | 20 | 115 | 41 |
| A5 | Porous | 44.2 | 0.9 | 29 | 17 | 186 | 31 |
| A6 | Porous | 28.5 | 1.1 | 26 | 18 | 133 | 35 |
| A7 | Porous | 29.9 | 3.1 | 19 | 18 | 121 | 37 |
| A8 | Porous | 31.5 | 0.6 | 27 | 19 | 142 | 41 |
| A9 | Porous | 16.4 | 0.6 | 21 | 13 | 65 | 18 |
| A10 | Porous | 20.2 | 1.0 | 22 | 16 | 111 | 23 |
| A11 | Porous | 19.1 | 1.0 | 17 | 20 | 103 | 48 |
| A12 | Porous | 40.5 | 2.4 | 21 | 35 | 88 | 28 |
| A13 | Porous | 33.1 | 1.1 | 22 | 13 | 55 | 18 |
| A14 | Porous | 42.2 | 0.8 | 19 | 11 | 101 | 17 |
| A15 | Porous | 24.1 | 0.7 | 28 | 19 | 158 | 30 |
| A16 | Porous | 17.1 | 1.0 | 24 | 18 | 186 | 28 |
| A17 | Porous | 30.8 | 0.5 | 22 | 18 | 125 | 25 |
| A18 | Porous | 15.5 | 1.3 | 24 | 20 | 165 | 33 |
| A19 | Porous | 23.3 | 0.3 | 33 | 22 | 177 | 38 |
| A20 | Porous | 35.6 | 2.3 | 18 | 23 | 85 | 41 |
| A21 | Porous | 38.4 | 0.3 | 19 | 20 | 92 | 35 |
| A22 | Porous | 36.0 | 0.5 | 24 | 21 | 106 | 35 |
| A23 | Porous | 37.2 | 0.3 | 22 | 20 | 104 | 28 |
| A24 | Solid | 30.5 | 0.0 | — | — | — | — |

TABLE 2-continued

| Resin particle No. | Shape of particle | Volume average particle diameter (μm) | Shell portion thickness (μm) | Core portion pore: Average pore diameter (nm) | Core portion pore: Average porosity (%) | Shell portion pore: Average pore diameter (nm) | Shell portion pore: Average porosity (%) |
|---|---|---|---|---|---|---|---|
| A25 | Multi-hollow | 20.2 | 0.0 | 795 | 1.6 | — | — |
| A26 | Single-hollow | 15.2 | 0.0 | 4110 | 1.9 | — | — |

In Table 2, the "Average pore diameter" and "Average porosity" of Resin Particle Nos. A25 and A26 are shown in "Core portion pore" for convenience, but these refer to the average pore diameter and average porosity of the entire resin particle.

TABLE 3

| | | Raw material resin particle No. | Volume average particle diameter of resin particle (μm) | Electro-conductive domain: Proportion (%) | Electro-conductive domain: Domain diameter (nm) | Electro-conductive domain: Region width (μm) | Electro-conductive domain: Proportion of region width to particle diameter (%) | Volume resistivity (Ω · cm) ×10^5 | Coating solution for surface layer Specific gravity (g/ml) | Surface layer Thickness (μm) | Thickness of matrix that is covering of resin particle (μm) | Surface roughness Rzjis (μm) | Surface roughness Rsm (μm) |
|---|---|---|---|---|---|---|---|---|---|---|---|---|---|
| Example | 1 | A1 | 18.1 | 27 | 115 | 1.3 | 7.2 | 4.5 | 0.9110 | 4.8 | 0.8 | 21.1 | 76 |
| | 2 | A2 | 28.0 | 44 | 201 | 1.1 | 3.9 | 5.3 | 0.9110 | 5.1 | 0.8 | 30.1 | 95 |
| | 3 | A3 | 29.5 | 20 | 96 | 0.5 | 1.7 | 5.2 | 0.9100 | 4.2 | 0.6 | 33.4 | 111 |
| | 4 | A4 | 14.9 | 36 | 127 | 1.1 | 7.4 | 4.2 | 0.9105 | 4.4 | 0.7 | 17.5 | 59 |
| | 5 | A5 | 44.0 | 28 | 196 | 1.0 | 2.3 | 6.2 | 0.9000 | 5.5 | 0.7 | 47.1 | 166 |
| | 6 | A6 | 28.1 | 31 | 142 | 1.1 | 3.9 | 5.0 | 0.9110 | 5.0 | 0.8 | 29.5 | 100 |
| | 7 | A7 | 28.9 | 34 | 133 | 2.8 | 9.7 | 5.3 | 0.9105 | 4.2 | 0.7 | 31.2 | 115 |
| | 8 | A7 | 29.5 | 32 | 130 | 2.8 | 9.5 | 5.9 | 0.9000 | 4.3 | 0.6 | 30.5 | 99 |
| | 9 | A8 | 31.5 | 38 | 145 | 0.5 | 1.6 | 5.6 | 0.9050 | 4.4 | 0.7 | 33.5 | 121 |
| | 10 | A9 | 16.5 | 12 | 88 | 0.6 | 3.6 | 4.5 | 0.9110 | 6.1 | 1.0 | 18.5 | 62 |
| | 11 | A10 | 20.0 | 20 | 120 | 1.1 | 5.5 | 4.5 | 0.9110 | 5.8 | 1.0 | 21.2 | 75 |
| | 12 | A11 | 18.6 | 46 | 117 | 1.0 | 5.4 | 4.8 | 0.9050 | 5.7 | 0.9 | 20.1 | 77 |
| | 13 | A12 | 40.1 | 22 | 105 | 2.0 | 5.0 | 5.9 | 0.9005 | 6.0 | 0.9 | 43.5 | 144 |
| | 14 | A13 | 32.1 | 13 | 82 | 0.9 | 2.8 | 5.2 | 0.9050 | 5.3 | 0.8 | 35.5 | 111 |
| | 15 | A14 | 40.3 | 16 | 119 | 0.7 | 1.7 | 6.3 | 0.9000 | 4.1 | 0.4 | 40.6 | 141 |
| | 16 | A15 | 23.3 | 29 | 168 | 0.8 | 3.4 | 5.2 | 0.9000 | 3.9 | 0.5 | 25.5 | 81 |
| | 17 | A16 | 16.5 | 22 | 194 | 1.1 | 6.7 | 5.0 | 0.9110 | 4.6 | 0.8 | 17.5 | 70 |
| | 18 | A17 | 29.1 | 23 | 144 | 0.5 | 1.7 | 5.8 | 0.9110 | 4.1 | 0.6 | 33.5 | 110 |
| | 19 | A18 | 15.2 | 30 | 172 | 1.3 | 8.6 | 4.1 | 0.9110 | 4.7 | 0.8 | 16.6 | 58 |
| | 20 | A19 | 23.1 | 33 | 195 | 0.5 | 2.2 | 4.9 | 0.9050 | 5.1 | 0.9 | 25.0 | 91 |
| | 21 | A20 | 33.8 | 38 | 103 | 2.1 | 6.2 | 5.3 | 0.9050 | 5.6 | 0.8 | 35.6 | 115 |
| | 22 | A21 | 38.1 | 28 | 113 | 0.4 | 1.0 | 5.8 | 0.9100 | 3.6 | 0.4 | 41.2 | 133 |
| | 23 | A22 | 35.8 | 32 | 131 | 0.6 | 1.7 | 6.0 | 0.9100 | 5.6 | 0.8 | 38.5 | 121 |
| | 24 | A23 | 35.5 | 25 | 121 | 0.4 | 1.1 | 5.6 | 0.9100 | 4.2 | 0.5 | 37.4 | 125 |
| | 25 | A1 | 18.0 | 21 | 118 | 1.3 | 7.2 | 4.8 | 0.9110 | 5.1 | 0.9 | 17.3 | 71 |

Note)
Proportion refers to the area % of the electro-conductive domain to the electro-conductive domain region in the cross section of the resin particle.

TABLE 4

| | | Raw material resin particle No. | Volume average particle diameter of resin particle (μm) | Electro-conductive domain: Proportion (%) | Electro-conductive domain: Domain diameter (nm) | Electro-conductive domain: Region width (μm) | Electro-conductive domain: Proportion of region width to particle diameter (%) | Volume resistivity (Ω · cm) ×10^5 | Coating solution for surface layer Specific gravity (g/ml) | Surface layer Thickness (μm) | Thickness of matrix that is covering of resin particle (μm) | Surface roughness Rzjis (μm) | Surface roughness Rsm (μm) |
|---|---|---|---|---|---|---|---|---|---|---|---|---|---|
| Comparative Example | 1 | A24 | 30.1 | 0 | 0 | 0.0 | 0.0 | 6.9 | 0.9100 | 5.8 | 1.1 | 24.2 | 60 |
| | 2 | A25 | 20.3 | 0 | 0 | 0.0 | 0.0 | 6.8 | 0.9100 | 4.1 | 0.7 | 19.5 | 71 |
| | 3 | A26 | 14.9 | 0 | 0 | 0.0 | 0.0 | 6.3 | 0.9105 | 5.4 | 1.0 | 13.1 | 51 |

Note)
Proportion refers to the area % of the electro-conductive domain to the electro-conductive domain region in the cross section of the resin particle.

TABLE 5

| | | Evaluation of image | | | | | | | | |
|---|---|---|---|---|---|---|---|---|---|---|
| | | Environment 1 | | | Environment 2 | | | Environment 3 | | |
| | | Image No. | | | | | | | | |
| | | 1 | 2 | 3 | 1 | 2 | 3 | 1 | 2 | 3 |
| Example | 1 | 1 | 1 | 2 | 1 | 1 | 1 | 1 | 1 | 1 |
| | 2 | 1 | 1 | 2 | 1 | 1 | 1 | 1 | 1 | 1 |
| | 3 | 1 | 1 | 1 | 1 | 1 | 1 | 1 | 1 | 1 |
| | 4 | 1 | 1 | 2 | 1 | 1 | 1 | 1 | 1 | 1 |
| | 5 | 1 | 1 | 1 | 1 | 1 | 1 | 1 | 1 | 1 |
| | 6 | 1 | 1 | 1 | 1 | 1 | 1 | 1 | 1 | 1 |
| | 7 | 2 | 3 | 3 | 1 | 2 | 3 | 1 | 1 | 2 |
| | 8 | 2 | 3 | 3 | 1 | 2 | 3 | 1 | 1 | 2 |
| | 9 | 1 | 1 | 1 | 1 | 1 | 1 | 1 | 1 | 1 |
| | 10 | 1 | 2 | 2 | 1 | 1 | 2 | 1 | 1 | 1 |
| | 11 | 1 | 1 | 2 | 1 | 1 | 2 | 1 | 1 | 1 |
| | 12 | 1 | 1 | 2 | 1 | 1 | 2 | 1 | 1 | 1 |
| | 13 | 1 | 2 | 2 | 1 | 2 | 2 | 1 | 1 | 2 |
| | 14 | 2 | 2 | 3 | 1 | 2 | 2 | 1 | 1 | 2 |
| | 15 | 1 | 2 | 2 | 1 | 1 | 2 | 1 | 1 | 1 |
| | 16 | 1 | 1 | 2 | 1 | 1 | 1 | 1 | 1 | 1 |
| | 17 | 1 | 1 | 2 | 1 | 1 | 2 | 1 | 1 | 1 |
| | 18 | 1 | 1 | 1 | 1 | 1 | 1 | 1 | 1 | 1 |
| | 19 | 1 | 1 | 2 | 1 | 1 | 2 | 1 | 1 | 1 |
| | 20 | 1 | 1 | 1 | 1 | 1 | 1 | 1 | 1 | 1 |
| | 21 | 1 | 2 | 3 | 1 | 2 | 2 | 1 | 1 | 2 |
| | 22 | 1 | 1 | 1 | 1 | 1 | 1 | 1 | 1 | 1 |
| | 23 | 1 | 1 | 1 | 1 | 1 | 1 | 1 | 1 | 1 |
| | 24 | 1 | 1 | 1 | 1 | 1 | 1 | 1 | 1 | 1 |
| | 25 | 1 | 1 | 2 | 1 | 1 | 2 | 1 | 1 | 1 |

TABLE 6

| | | Evaluation of image | | | | | | | | |
|---|---|---|---|---|---|---|---|---|---|---|
| | | Environment 1 | | | Environment 2 | | | Environment 3 | | |
| | | Image No. | | | | | | | | |
| | | 1 | 2 | 3 | 1 | 2 | 3 | 1 | 2 | 3 |
| Comparative Example | 1 | 2 | 4 | 4 | 2 | 3 | 4 | 1 | 3 | 3 |
| | 2 | 2 | 4 | 4 | 2 | 4 | 4 | 2 | 3 | 3 |
| | 3 | 3 | 4 | 4 | 3 | 4 | 4 | 2 | 4 | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-195723, filed Sep. 20, 2013, which is hereby incorporated by reference herein in its entirety.

REFERENCE SIGNS LIST

1 electro-conductive substrate
2 electro-conductive elastic layer
3 electro-conductive surface layer
104 resin particle
201 electro-conductive domain
301 center of gravity

What is claimed is:

1. A charging member comprising:

an electro-conductive substrate and an electro-conductive surface layer, the surface layer comprising a matrix including a binder resin and an electro-conductive fine particle, and having a resin particle dispersed in the matrix, the charging member having a protrusion provided by the resin particle on a surface of the charging member, the resin particle including a plurality of electro-conductive domains inside of the resin particle, wherein the electro-conductive domains are localized in the vicinity of the surface of the resin particle, (i) wherein the resin particle is assumed to be a solid resin particle, defining a first circle having an area equal to the area of a cross section passing through the center of gravity of the solid resin particle, and defining a second circle that is a concentric circle defined within the first circle, the second circle having a diameter that is 0.8 times the length of the diameter of the first circle:

(ii) wherein the first and second circle define a doughnut-shaped portion between the first circle and the second circle:

(iii) wherein in the cross section passing through the center of gravity of the solid resin particle, a region surrounded by the surface of the solid resin particle and a line equally spaced from the surface is defined so as to have an area equal to that of the doughnut-shaped portion; and (iv) wherein the region defined in the step (iii) includes more than 50% of the electro-conductive domains located in the cross section of the solid resin particle based on the number of electro-conductive domains.

2. The charging member according to claim 1, wherein a volume average particle diameter of the resin particle is 5 to 60 μm.

3. The charging member according to claim 1, wherein a thickness of the matrix covering the resin particle is 0.05 to 2 μm.

4. The charging member according to claim 1, wherein a primary particle of the electro-conductive fine particle has an average particle diameter of 10 to 100 nm.

5. The charging member according to claim 1, wherein the electro-conductive fine particle is at least one selected from the group consisting of metal fine particles, metal oxide fine particles, carbon black, and composite electro-conductive fine particles prepared by covering metal oxides with carbon black.

6. A method of producing a charging member, comprising a step of:

forming a coat of a coating solution for forming a surface layer on an electro-conductive substrate, the coating solution comprising a binder resin, an electro-conductive fine particle, a core-shell type porous resin particle having a pore, and a solvent, wherein an average pore diameter in a shell portion of the porous resin particle is larger than an average pore diameter in a core portion, and a volume average particle diameter of the electro-conductive fine particle is larger than the average pore diameter in the core portion and smaller than the average pore diameter in the shell portion, whereby the step forms a charging member according to claim 1.

7. The method of producing the charging member according to claim 6, wherein the average pore diameter in the core portion of the porous resin particle is 10 to 50 nm, and the average pore diameter in the shell portion of the porous resin particle is 40 to 500 nm.

8. A process cartridge detachably mountable to a main body of an electrophotographic apparatus, comprising the charging member according to claim 1, and an electrophotographic photosensitive member arranged in contact with the charging member.

9. An electrophotographic apparatus comprising the charging member according to claim 1, and an electrophotographic photosensitive member arranged in contact with the charging member.

* * * * *